US010598337B2

(12) United States Patent
Jo et al.

(10) Patent No.: US 10,598,337 B2
(45) Date of Patent: Mar. 24, 2020

(54) LAMP FOR VEHICLES AND VEHICLE HAVING THE SAME

(71) Applicant: ZKW Group GmbH, Wieselburg (AT)

(72) Inventors: Juung Jo, Seoul (KR); Hankyu Cho, Seoul (KR)

(73) Assignee: ZKW Group GmbH, Wieselburg (AT)

( * ) Notice: Subject to any disclaimer, the term of this patent is extended or adjusted under 35 U.S.C. 154(b) by 12 days.

(21) Appl. No.: 15/859,027

(22) Filed: Dec. 29, 2017

(65) Prior Publication Data

US 2019/0056083 A1 Feb. 21, 2019

(30) Foreign Application Priority Data

Aug. 21, 2017 (KR) ..... 10-2017-0105575

(51) Int. Cl.

| | |
|---|---|
| ***F21V 21/00*** | (2006.01) |
| ***F21S 43/20*** | (2018.01) |
| ***F21S 43/14*** | (2018.01) |
| ***F21S 41/153*** | (2018.01) |
| ***F21S 41/26*** | (2018.01) |
| ***F21S 41/255*** | (2018.01) |
| *F21W 103/35* | (2018.01) |
| *F21W 103/55* | (2018.01) |
| *F21S 41/147* | (2018.01) |
| *F21S 41/143* | (2018.01) |

(52) U.S. Cl.

CPC ..... *F21S 43/26* (2018.01); *F21S 41/153* (2018.01); *F21S 41/255* (2018.01); *F21S 41/26* (2018.01); *F21S 43/14* (2018.01); *F21S 41/143* (2018.01); *F21S 41/147* (2018.01); *F21W 2103/35* (2018.01); *F21W 2103/55* (2018.01)

(58) Field of Classification Search

CPC .. F21S 41/14–155; F21S 41/25; F21S 41/255; F21S 41/26; F21S 43/13–26

USPC ..... 362/511, 520–522, 543–545

See application file for complete search history.

(56) References Cited

U.S. PATENT DOCUMENTS 7,988,345 B2 * 8/2011 Rosenhahn ..... F21V 5/08 362/538

2011/0205049 A1 8/2011 Kmetec et al.

FOREIGN PATENT DOCUMENTS

| | | |
|---|---|---|
| DE | 102011112285 | 3/2013 |
| DE | 102013104176 | 10/2014 |
| EP | 2690348 | 1/2014 |
| EP | 3208529 | 8/2017 |
| JP | 2002260422 | 9/2002 |
| JP | 2009049566 | 3/2009 |
| JP | 2013054849 | 3/2013 |

(Continued)

OTHER PUBLICATIONS

Extended European Search Report in European Appln. No. 18184502.5, dated Feb. 6, 2019, 10 pages.

*Primary Examiner* — Jason M Han

(74) *Attorney, Agent, or Firm* — Fish & Richardson P.C.

(57) ABSTRACT

A lamp for a vehicle includes: a light generation unit including an array provided with a plurality of micro-light emitting diode (micro-LED) chips arranged therein; and a lens configured to redirect light beams generated by the light generation unit. The light generation unit is configured to output a plurality of beams having a divergence angle defined in a vertical direction. The lens is arranged to have a largest vertical cross-section thereof inscribed in the divergence angle of the beams that are output from the light generation unit.

20 Claims, 27 Drawing Sheets

(56) References Cited

FOREIGN PATENT DOCUMENTS

| | | |
|---|---|---|
| JP | 2013509714 | 3/2013 |
| JP | 2013178946 | 9/2013 |
| JP | 2015015264 | 1/2015 |
| JP | 2015079660 | 4/2015 |

* cited by examiner

200

LAMP FOR VEHICLES AND VEHICLE HAVING THE SAME

CROSS-REFERENCE TO RELATED APPLICATION

This application claims the benefit of an earlier filing date and right of priority to Korean Patent Application No. 10-2017-0105575, filed Aug. 21, 2017 in the Korean Intellectual Property Office, the disclosure of which is incorporated herein by reference.

TECHNICAL FIELD

The present disclosure relates to a lamp for vehicles and a vehicle having the same.

BACKGROUND

In general, a vehicle is an apparatus which moves a user riding therein in a desired direction. A common example of a vehicle is a car.

Various lamps are typically provided in a vehicle. For example, a vehicle typically implements head lamps, rear combination lamps, daytime running lamp (DRLs), and fog lamps. Various devices may be used as light sources of such lamps provided in the vehicle.

SUMMARY

Implementations disclosed herein enable a lamp for a vehicle that utilizes a plurality of micro-LEDs and a lens configured to efficiently redirect light from the plurality of micro-LEDs.

In one aspect, a lamp for a vehicle includes: a light generation unit including an array provided with a plurality of micro-light emitting diode (micro-LED) chips arranged therein; and a lens configured to redirect light beams generated by the light generation unit. The light generation unit is configured to output a plurality of beams having a divergence angle defined in a vertical direction. The lens is arranged to have a largest vertical cross-section thereof inscribed in the divergence angle of the beams that are output from the light generation unit.

In some implementations, the array including the plurality of micro-LED chips includes: a first group of micro-LED chips arranged at an uppermost portion of the array and configured to output first beams; and a second group of micro-LED chips arranged at a lowermost portion of the array and configured to output second beams. The divergence angle is defined between the first beams output from the first group of micro-LED chips and the second beams output from the second group of micro-LED chips.

In some implementations, the largest vertical cross-section of the lens contacts a first plane that extends from the first group of micro-LED chips and that forms an angle of 55 to 65 degrees in the upward direction relative to a first optical axis of the first group of micro-LED chips.

In some implementations, the largest vertical cross-section of the lens contacts a second plane that extends from the second group of micro-LED chips and that forms an angle of 55 to 65 degrees in the downward direction relative to a second optical axis of the second group of micro-LED chips.

In some implementations, the lens is configured to have a diameter along the largest vertical cross-section that is based on a width of the array formed in the vertical direction.

In some implementations, wherein the lens is configured to have a diameter along the largest vertical cross-section that is 2 times to 10 times the width of the array formed in the vertical direction.

In some implementations, the lamp for a vehicle further includes an air layer that is defined between the array and the lens.

In some implementations, the air layer is defined to have a thickness of 0.1 mm to 5 mm.

In some implementations, a curvature of the lens defines at least one side of the air layer having a convex shape curving away from the array.

In some implementations, the lens is configured to have a hollow interior formed therein.

In some implementations, the lens includes a first member and a second member that together define the hollow interior therebetween. The first member is located between the array and the hollow interior, and the second member is located between the hollow interior and an outside of a vehicle towards which light from the array is directed by the lens.

In some implementations, a second thickness of the second member of the lens is greater than a first thickness of the first member of the lens.

In some implementations, the lens is configured to have the largest vertical cross-section that includes: a first cross-sectional portion that is in the shape of a part of a first circle having a first radius; and a second cross-sectional portion that is adjacent to the first cross-sectional portion and that is in the shape of a part of a second circle having a second radius.

In some implementations, the first cross-sectional portion of the lens is located closer to the array than the second cross-sectional portion of the lens.

In some implementations, the first radius is greater than the second radius.

In some implementations, a maximum thickness of the second shape is greater than a maximum thickness of the first shape.

In some implementations, the lens includes one or more bent parts formed along a length direction of the lens.

In another aspect, a lamp for a vehicle includes: a light generation unit including an array provided with a plurality of micro-light emitting diode (micro-LED) chips arranged therein; and a lens that is configured to redirect light generated by the light generation unit. The plurality of micro-LED chips in the light generation unit includes: at least one first micro-LED chip configured to output an uppermost portion of the light generated by the light generation unit; and at least one second micro-LED chip configured to output a lowermost portion of the light generated by the light generation unit. The lens is configured to redirect the light generated by the light generation unit by redirecting light that extends from the uppermost portion to the lowermost portion of the light generated by the light generation unit.

In some implementations, the uppermost portion of the light is defined by a first plane that extends outward from the at least first micro-LED chip. The lowermost portion of the light is defined by a second plane that extends outward from the at least one second micro-LED chip. The lens is configured to be inscribed within the first plane and the second plane.

In some implementations, the lens is configured to have a maximum cross-sectional width in a vertical direction that is 2 times to 10 times a width of the array in the vertical direction.

The details of one or more implementations are set forth in the accompanying drawings and the description below. Other features will be apparent from the description and drawings, and from the claims. The description and specific examples below are given by way of illustration only, and various changes and modifications will be apparent.

BRIEF DESCRIPTION OF THE DRAWINGS

FIGS. 10A and 103 are schematic views briefly illustrating the array and micro-LED chips in accordance with the implementation;

DETAILED DESCRIPTION

Light that is output from lamps of a vehicle, such as daytime running lamps (DRLs), tail lamps, and brake lamps, is typically designed to have high uniformity of output while maintaining proper illumination.

However, vehicle lamps that implement conventional LEDs or LDs may have difficulty in achieving high uniformity of output.

Implementations disclosed herein enable a lamp for a vehicle that utilizes a plurality of micro-LEDs and that is better able to maintain proper illumination while achieving high uniformity of output.

In the following description, a vehicle may be any suitable motorized vehicle and may include cars, motorcycles, etc. Hereinafter, description will be given using an example of a vehicle as a car.

In the following description, a vehicle may be powered by any suitable source of power, and may include, for example, an internal combustion engine vehicle provided with an engine as a power source, a hybrid electric vehicle provided with an engine and an electric motor as power sources, an electric vehicle provided with an electric motor as a power source, etc.

In the following description, the left side of a vehicle refers to the left side in a driving direction of the vehicle, and the right side of the vehicle refers to the right side in the driving direction of the vehicle.

Figure 1A:
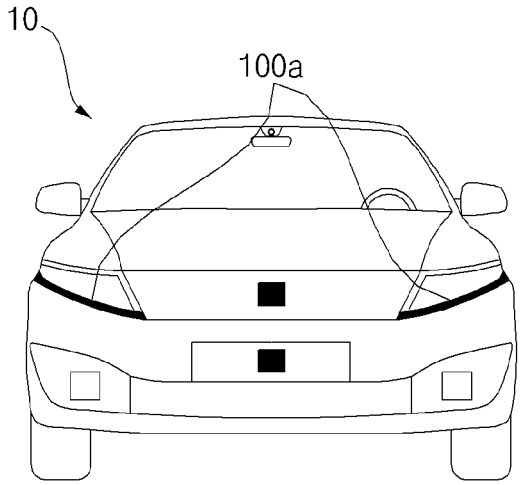
FIGS. 1A and 1B are views illustrating an external appearance of a vehicle in accordance with one implementation.
Figure 1B:
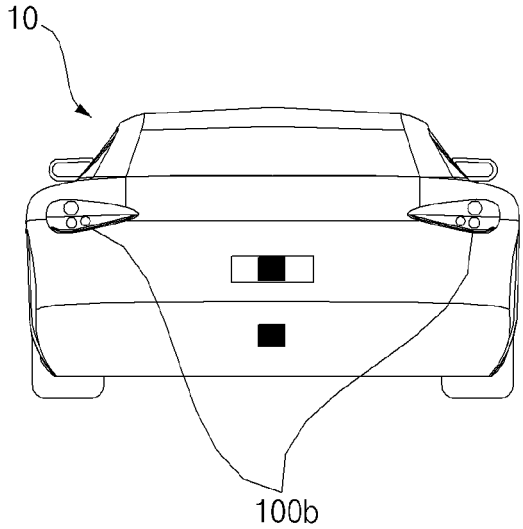

FIGS. 1A and 1B are views illustrating an external appearance of a vehicle in accordance with one implementation.

With reference to FIGS. 1A and 1B, a vehicle 10 may include vehicle lamps 100.

The vehicle lamps 100 may include head lamps 100, rear combination lamps 100*b*, and fog lamps 100*c*.

The vehicle lamps 100 may further include room lamps, turn signal lamps, daytime running lamps 100*a*, reverse lamps, positioning lamps, etc.

Here, an overall length means a length from the front part to the rear part of the vehicle 10, an overall width means a width of the vehicle 10, and an overall height means a length from the lower parts of wheels to a roof of the vehicle 10. In the following description, an overall length direction L may mean a direction serving as a criterion for measuring the overall length of the vehicle 10, an overall width direction W may mean a direction serving as a criterion for measuring the overall width of the vehicle 10, and an overall height direction H may mean a direction serving as a criterion for measuring the overall height of the vehicle 10.

Figure 2:
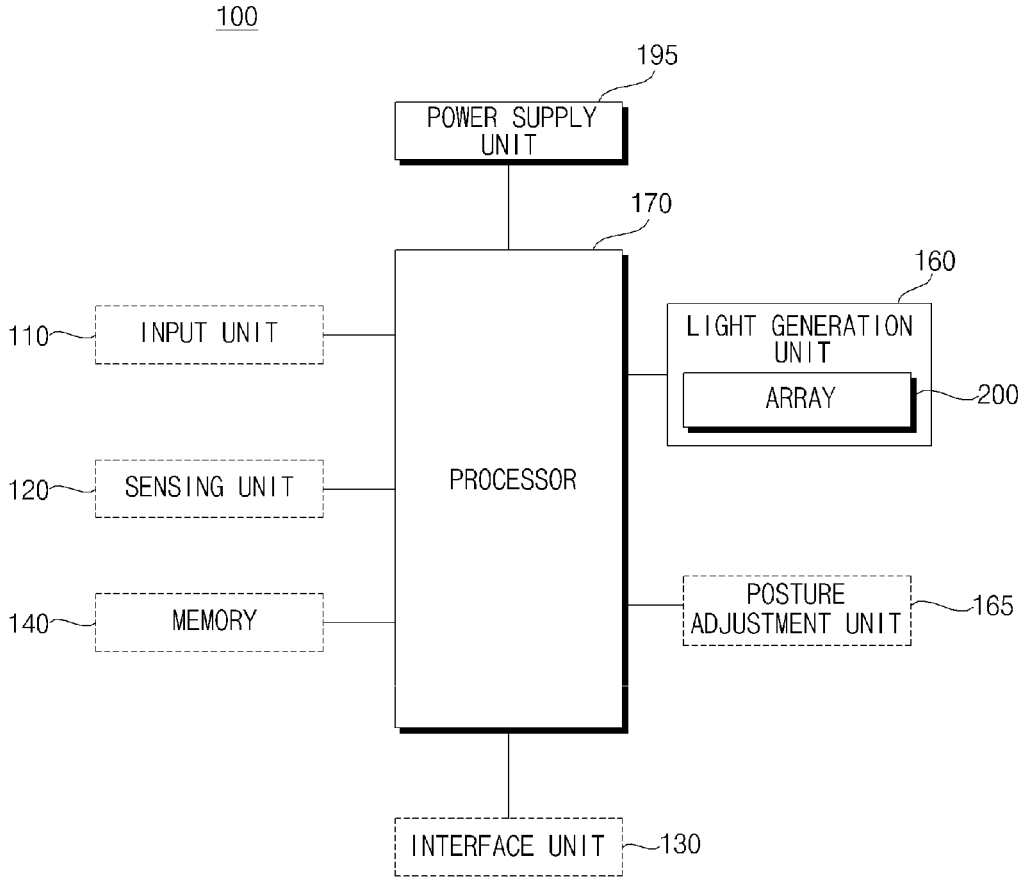
FIG. 2 is a block diagram of a lamp for vehicles in accordance with one implementation.

FIG. 2 is a block diagram of a vehicle lamp in accordance with one implementation.

With reference to FIG. 1, a vehicle lamp 100 may include a light generation unit 160, a processor 170 and a power supply unit 190.

The vehicle lamp 100 may further include an input unit 110, a sensing unit 120, an interface unit 130, a memory 140 and a posture adjustment unit 165 individually or in combination.

The input unit 110 may receive user input to control the vehicle lamp 100.

The input unit 110 may include one or more input devices. For example, the input unit 110 may include at least one of a touch input device, a mechanical input device, a gesture input device and a voice input device.

The input unit 110 may receive user input to control operation of the light generation unit 160.

For example, the input unit 110 may receive user input to control turning-on operation or turning-off operation of the light generation unit 160.

The sensing unit 120 may include one or more sensors.

For example, the sensing unit 120 may include a temperature sensor or an illumination sensor.

The sensing unit 120 may acquire temperature information of the light generation unit 160.

The sensing unit 120 may acquire illumination information at the outside of the vehicle 10.

The interface unit 130 may exchange information, signals or data with other devices provided in the vehicle 10.

The interface unit 130 may transmit information, signals or data received from other devices provided in the vehicle to the processor 170.

The interface unit 130 may transmit information, signals or data generated by the processor 170 to other devices provided in the vehicle 10.

The interface unit 130 may receive driving condition information.

The driving condition information may include at least one of object information at the outside of the vehicle 10, navigation information and vehicle state information.

The object information at the outside of the vehicle 10 may include information as to whether or not an object is present, position information of the object, movement information of the object, distance information of the object from the vehicle 10, relative velocity information of the object to the vehicle 10, and information regarding kinds of objects.

The object information may be generated by an object detection device provided in the vehicle 10. The object detection device may detect an object based on sensing data generated by one or more selected from a camera, a radar, a lidar, an ultrasonic sensor and an infrared sensor.

Here, objects may include traffic lanes, other vehicles, pedestrians, two-wheeled vehicles, traffic signals, light, roads, structures, speed bumps, landmarks, animals, etc.

The navigation information may include at least one of map information, set destination information, path information due to setting of the destination, information regarding various objects on a path, traffic lane information and current position information of the vehicle 10.

The navigation information may be generated by a navigation apparatus provided in the vehicle 10.

The vehicle state information may include vehicle dynamic information, vehicle velocity information, vehicle inclination information, vehicle weight information, vehicle direction information, vehicle battery information, vehicle fuel information, vehicle tire pressure information, vehicle steering information, vehicle indoor temperature information, vehicle indoor humidity information, pedal position information, engine temperature information, etc.

The vehicle state information may be generated based on sensing information acquired by various sensors provided in the vehicle 10.

The memory 140 may store basic data of respective units of the vehicle lamp 100, control data to control operations of the respective units, and data input to or output from the vehicle lamp 100.

The memory 140 may be one of various storage devices, such as a ROM, a RAM, an EPROM, a flash drive, a hard drive, etc., hardware-wise.

The memory 140 may store various kinds of data to control the overall operation of the vehicle lamp 100, such as programs for processing or control through the processor 170.

The memory 140 may be classified as a lower-level component of the processor 170.

The light generation unit 160 may convert electric energy into light energy under the control of the processor 170.

The light generation unit 160 may include an array 200 in which a plurality of groups of micro-light emitting diode (LED) chips is arranged.

The array 200 may be formed to be flexible.

The micro-LED chips of the groups may have different shapes.

According to implementations, a plurality of arrays may be provided. The arrays may form an array module 200*m* (in FIG. 6).

According to implementations, in the array module 200*m*, the arrays may be stacked.

The array module 200*m* may be formed to be flexible.

For example, the array 200 having flexibility may be formed by disposing a flexible copper clad laminate (FCCL) on a base 911 (in FIG. 5) formed of a flexible material and transferring micro-LED chips having a size of several μm onto the FCCL.

The micro-LED chips may be referred to as micro-LED packages.

The micro-LED chips may include light emitting diodes (LEDs) therein.

The micro-LED chips may have a size of several μm. For example, the micro-LED chips may have a size of 5-15 μm.

The LEDs of the micro-LED chips may be transferred onto a substrate.

The array 200 may include a plurality of sub-arrays in which a plurality of micro-LED chip groups is respectively arranged.

The sub-arrays may have various shapes.

For example, the sub-arrays may have various figure shapes having designated areas.

For example, the sub-arrays may have a circular shape, a polygonal shape, a fan shape, etc.

The substrate may include a flexible copper clad laminate (FCCL).

For example, the base 911 (in FIG. 5) and a first electrode 912 (in FIG. 5) may form a substrate.

For example, a base 911 (in FIG. 8) and a second anode 912*b* (in FIG. 8) may form a substrate.

The posture adjustment unit 165 may adjust the posture of the light generation unit 160.

The posture adjustment unit 165 may tilt the light generation unit 160. Light output from the light generation unit 160 may be adjusted so as to travel in the upward and downward directions (for example, in the overall height direction), according to tilting of the light generation unit 160.

The posture adjustment unit 165 may pan the light generation unit 160. Light output from the light generation unit 160 may be adjusted so as to travel in the leftward and rightward directions (for example, in the overall width direction), according to panning of the light generation unit 160.

The posture adjustment unit 165 may include a driving power generation unit to provide driving power necessary to adjust the posture of the light generation unit 160 (for example, a motor, an actuator or a solenoid).

If the light generation unit 160 generates low beams, the posture adjustment unit 165 may adjust the posture of the light generation unit 160 so as to output light to a lower area than if the light generation unit 160 generates high beams.

If the light generation unit 160 generates high beams the posture adjustment unit 165 may adjust the posture of the light generation unit 160 so as to output light to a higher area than if the light generation unit 160 generates low beams.

The processor 170 may be conductively connected to the respective components of the vehicle lamp 100. The processor 170 may control the overall operations of the respective components of the vehicle lamp 100.

The processor 170 may control the light generation unit 160.

The processor 170 may control the light generation unit 160 by adjusting an amount of electrical energy supplied to the light generation unit 160.

The processor 170 may control the array 200 according to regions.

For example, the processor 170 may control the array 200 according to regions by supplying different amounts of electrical energy to the micro-LED chips arranged in the respective regions of the array 200.

The processor 170 may control the array module 200*m* according to layers.

The arrays 200 of the array module 200*m* may form the respective layers of the array module 200*m*.

For example, the processor 170 may control the array module 200*m* according to layers by supplying different amounts of electrical energy to the respective layers of the array module 200*m*.

The processor 170 may individually control the sub-arrays.

For example, the processor 170 may control the sub-arrays so as to sequentially output generated beams in a designated direction, based on the arrangement positions of the sub-arrays.

The power supply unit 190 may supply electrical energy necessary to operate the respective units of the vehicle lamp 100, under the control of the processor 170. Particularly, the power supply unit 190 may receive power from a battery, etc. in the vehicle 100.

Figure 3A:
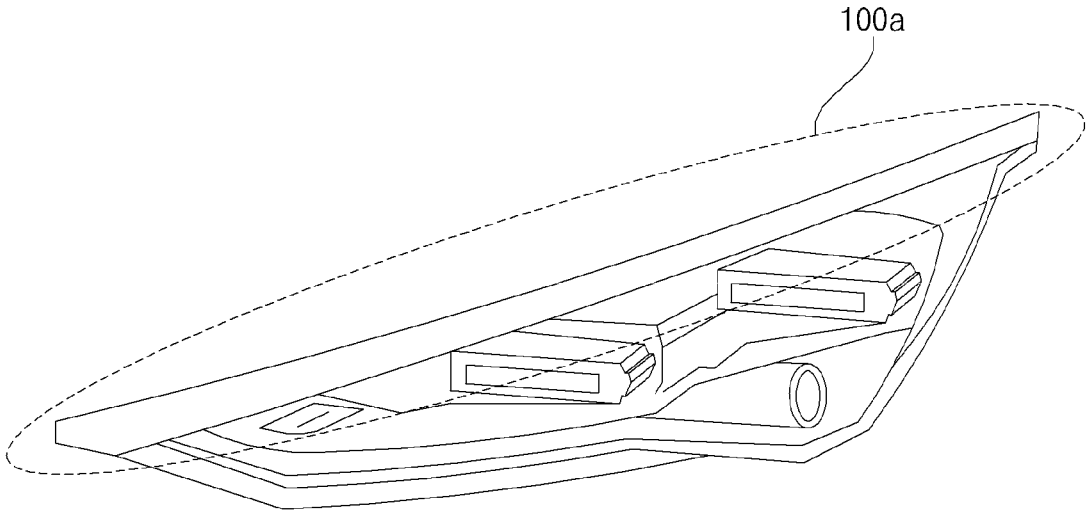
FIGS. 3A and 3B are reference views illustrating vehicle lamps in accordance with implementations of the present disclosure.
Figure 3B:
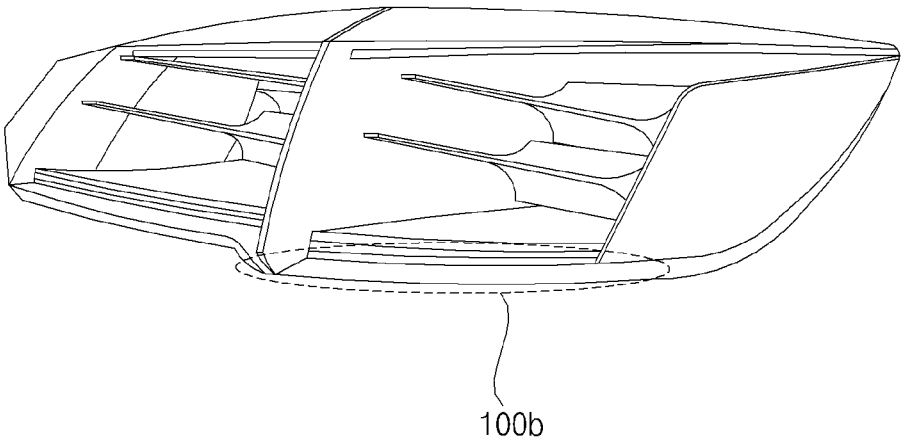

FIGS. 3A and 3B are reference views illustrating vehicle lamps in accordance with implementations of the present disclosure.

FIG. 3A exemplarily illustrates a daytime running lamp 100*a* as a vehicle lamp.

In order to allow other vehicle drivers to recognize the vehicle 100 while minimizing glare, light output from the daytime running lamp 100*a* needs to be uniform.

For this purpose, in the daytime running lamp 100*a*, a lens may have a circular or oval vertical cross-section.

FIG. 3B exemplarily illustrates a tail lamp 100*b* as a vehicle lamp.

In order to allow other vehicle drivers to recognize the vehicle 100 while minimizing glare, light output from the tail lamp 100*b* needs to be uniform.

For this purpose, in the tail lamp 100*a*, a lens may have a circular or oval vertical cross-section.

The vehicle lamp 100 in accordance with the present disclosure may be applied to a brake lamp in addition to the daytime running lamp 100*a* and the tail lamp 100*b*.

Figure 4:
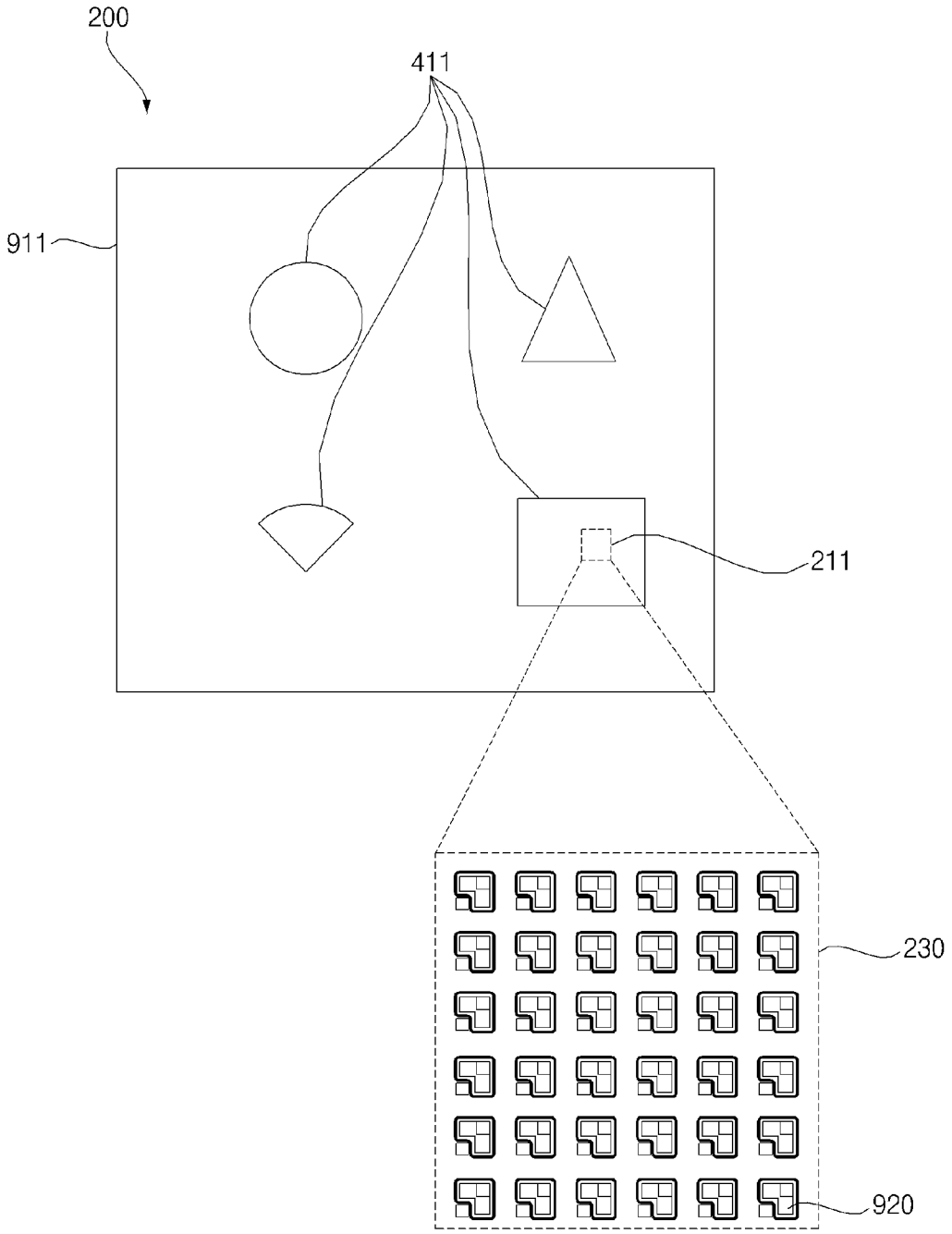
FIG. 4 is a reference view illustrating an array provided with a plurality of micro-LED chips arranged therein, in accordance with the implementation.

FIG. 4 is a reference view illustrating the array provided with a plurality of micro-LED chips arranged therein, in accordance with the implementation.

With reference to FIG. 4, a plurality of micro-LED chips 920 may be arranged in the array 200.

In the array 200, the micro-LED chips 920 may be formed by transfer.

An arrangement interval and density (i.e., the number of micro-LED chips per unit area) of the micro-LED chips 920 in the array 200 may be determined based on a transfer interval.

The array 200 may include a plurality of sub-arrays 411 in which a plurality of groups of micro-LED chips 920 is respectively arranged.

The array 200 may include a base 911 and one or more sub-arrays 411.

The base 911 may be formed of a material, such as polyimide (PI).

According to implementations, the base 911 may be substrate. For example, the base 911 may be a flexible copper clad laminate (FCCL) which will be described later.

The sub-arrays 411 may be arranged on the base 911.

In the sub-array 411, a plurality of micro-LED chips 920 may be arranged.

The sub-arrays 411 may be formed by cutting a main array formed by arranging the micro-LED chips 920 on the FCCL.

In this case, the shapes of the sub-arrays 411 may be determined based on cut-out shapes of the main array.

For example, the sub-arrays 411 may have 2D figure shapes (for example, a circular shape, a polygonal shape and a fan shape).

Figure 5:
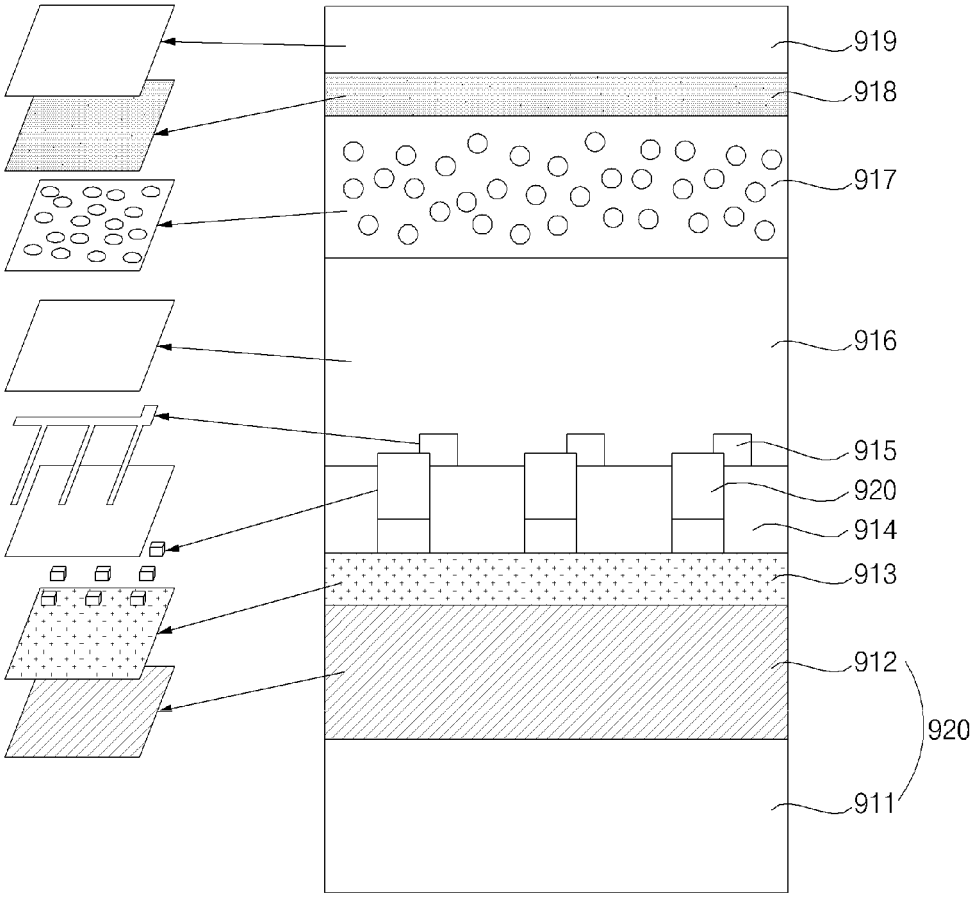
FIG. 5 is a reference view illustrating the array provided with the micro-LED chips arranged therein, in accordance with the implementation.

FIG. 5 is a reference view illustrating the array provided with the micro-LED chips arranged therein, in accordance with the implementation.

With reference to FIG. 5, the array 200 may include a polyimide layer 911, a flexible copper clad laminate (FCCL) 912, a reflective layer 913, an interlayer dielectric film 914, a plurality of micro-LED chips 920, a second electrode 915, an optical spacer 916, a phosphor layer 917, a color filter film 918 and a cover film 919.

The polyimide layer 911 may be formed to be flexible.

The FCCL 912 may be formed of copper. The FCCL 912 may be referred to as a first electrode.

According to implementations, the polyimide layer 911 and the FCCL 912 may be referred to as a base 910.

According to implementations, the polyimide layer 911 may be referred to as a base.

The first electrode 912 and the second electrode 915 may conductively connected to the micro-LEDs 920 and thus provide power to the micro-LEDs 920.

The first electrode 912 and the second electrode 915 may be transparent electrodes.

The first electrode 912 may be an anode.

The second electrode 915 may be a cathode.

The first electrode 912 and the second electrode 915 may include a metal, for example, any one selected from the group consisting of nickel (Ni), platinum (Pt), ruthenium (Ru), iridium (Ir), rhodium (Rh), tantalum (Ta), molybdenum (Mo), titanium (Ti), silver (Ag), tungsten (W), copper (Cu), chrome (Cr), palladium (Pd), vanadium (V), cobalt (C), niobium (Nb), zirconium (Zr), indium tin oxide (ITO), aluminum zinc oxide (AZO) and indium zinc oxide (IZO), or an alloy thereof.

The first electrode 912 may be formed between the polyimide film 911 and the reflective layer 913.

The second electrode 915 may be formed on the interlayer dielectric film 914.

The reflective layer 913 may be formed on the FCCL 912. The reflective layer 913 may reflect light generated by the micro-LED chips 920. The reflective layer 913 may be formed of silver (Ag).

The interlayer dielectric film 914 may be formed on the reflective layer 913.

The micro-LED chips 920 may be formed on the FCCL 912. The micro-LED chips 920 may be adhered to the reflective layer 913 or the FCCL 912 through solder or an anisotropic conductive film (ACF).

Here, the micro-LED chips 920 may include LED chips having a size of 10-100 μm.

The optical spacer 916 may be formed on the interlayer dielectric film 914. The optical spacer 916 serves to maintain a distance between the micro-LED chips 920 and the phosphor layer 917 and may be formed of an insulating material.

The phosphor layer 917 may be formed on the optical spacer 916. The phosphor layer 917 may be formed of a resin in which phosphors are uniformly dispersed. At least one of a blue phosphor, a blue-green phosphor, a green phosphor, a yellow-green phosphor, a yellow phosphor, a yellow-red phosphor, an orange phosphor and a red phosphor may be used according to the wavelength of light emitted by the micro-LED chips 920.

That is, the phosphors may be excited by light having first beams emitted by the micro-LED chips 920 and thus generate second beams.

The color filter film 918 may be formed on the phosphor layer 917. The color filter film 918 may implement a designated color in light passed through the phosphor layer 917. The color filter film 918 may implement at least one of red (R), green (G) and blue (B), or a color formed by a combination thereof.

The cover film 919 may be formed on the color filter film 918. The cover film 919 may protect the array 200.

Figure 6:
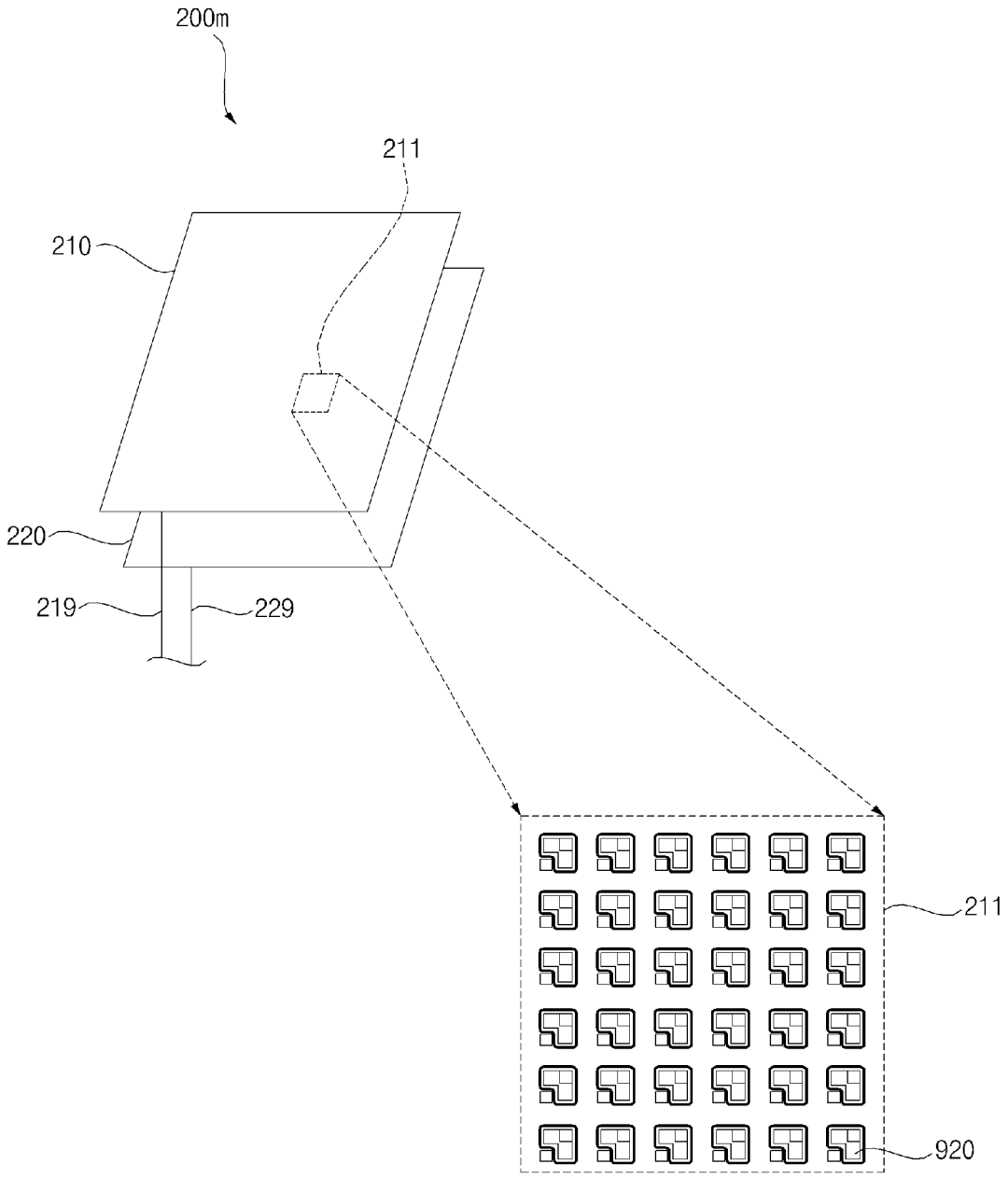
FIG. 6 is a reference view illustrating an array module including a plurality of arrays in accordance with the implementation.

FIG. 6 is a reference view illustrating the array module in accordance with the implementation.

With reference to FIG. 6, the light generation unit 160 may include the array module 200*m* including a plurality of arrays.

For example, the light generation unit 160 may include a first array 210 and a second array 220.

At least one of an arrangement interval between micro-LED chips, arrangement positions of the micro-LED chips and a density of the micro-LED chips of the first array 210 may be different from that of the second array 220.

At least one of an arrangement interval between micro-LED chips, arrangement positions of the micro-LED chips and a density of the micro-LED chips of the second array 220 may be different from that of the first array 210.

As an example, the density of the micro-LED chips may refer to the number of the micro-LED chips per unit area.

In the first array 210, a first group of micro-LED chips may be arranged in a first pattern.

The first pattern may be determined by at least one of the arrangement interval between the micro-LED chips of the first group, the arrangement positions of the micro-LED chips of the first group and the density of the micro-LED chips of the first group.

The micro-LED chips included in the first array 210 may be arranged at a first interval.

The micro-LED chips included in the first group may be arranged at the first interval.

In the second array 220, a second group of micro-LED chips may be arranged in a second pattern differing from the first pattern.

The second pattern may be determined by at least one of the arrangement interval between the micro-LED chips of the second group, the arrangement positions of the micro-LED chips of the second group and the density of the micro-LED chips of the second group.

The micro-LED chips included in the second array 220 may be arranged at the same interval as the interval between the micro-LED chips included in the first array 210.

The micro-LED chips included in the second group may be arranged at the same interval as the interval between the micro-LED chips included in the first group.

That is, the micro-LED chips included in the second group may be arranged at the first interval.

The micro-LED chips included in the second group may be arranged so as not to overlap the micro-LED chips included in the first group in the vertical direction or in the horizontal direction.

For example, the micro-LED chips of the first group may be arranged in the first array 210 so as not to overlap the micro-LED chips of the second group, as the first and second arrays 210 and 220 in the overlap state are seen from the top.

For example, the micro-LED chips of the second group may be arranged in the second array 220 so as not to overlap the micro-LED chips of the first group, as the first and second arrays 210 and 220 in the overlap state are seen from the top.

Through such arrangement, interference of the first group of the micro-LED chips with light output of the second group of the micro-LED chips may be minimized.

According to implementations, the light generation unit 160 may include three or more arrays.

Figure 7A:
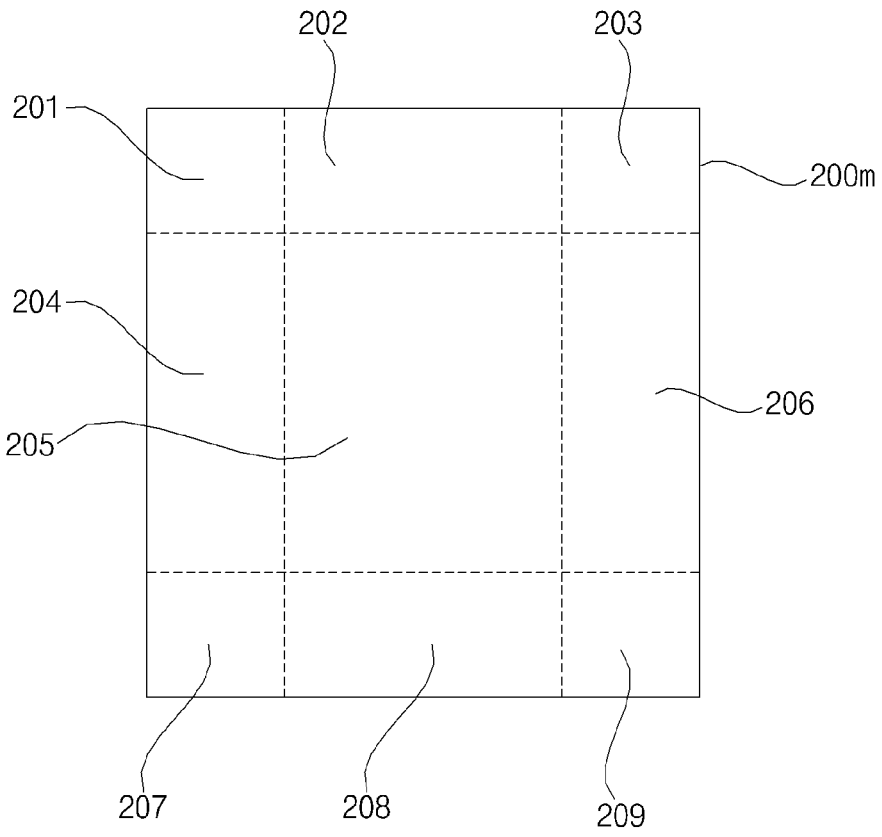
FIG. 7A is an elevation view exemplarily illustrating the array module in an overlap state of the arrays.

FIG. 7A is an elevation view exemplarily illustrating the array module in an overlap state of a plurality of arrays.

Figure 7B:
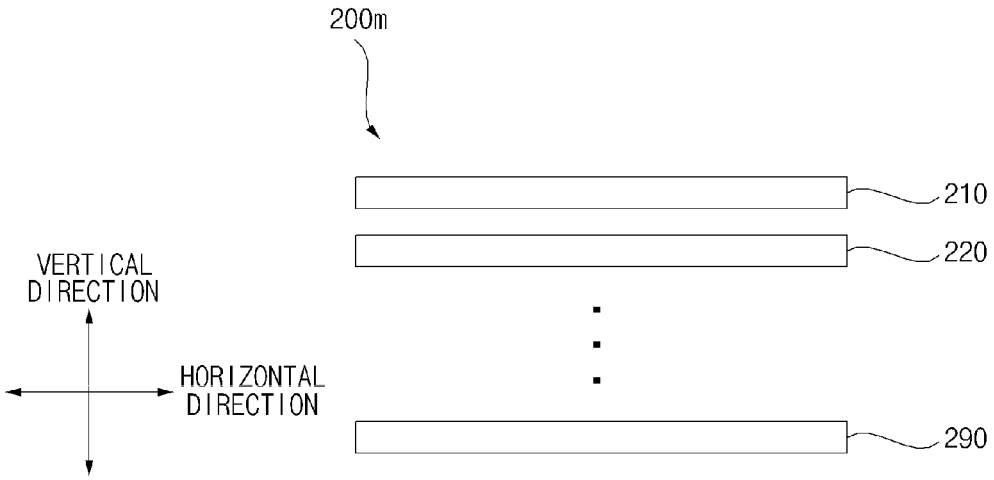
FIG. 7B is a side view exemplarily illustrating the array module in the overlap state of the arrays.

FIG. 7B is a side view exemplarily illustrating the array module in the overlap state of the arrays.

With reference to FIGS. 7A and 7B, the processor 170 may control the array module 200*m* according to regions 201 to 209.

The processor 170 may adjust a light distribution pattern by controlling the array module 200*m* according to the regions 201 to 209.

The array module 200*m* may be divided into a plurality of regions 201 to 209.

The processor 270 may adjust amounts of electrical energy supplied to the respective regions 201 to 209.

The processor 170 may control the array module 200*m* according to layers.

The processor 170 may adjust the intensity of output light by controlling the array module 200*m* according to layers.

The array module 200*m* may include a plurality of layers. Each layer may be formed by each of the arrays.

For example, a first layer of the array module 200*m* may be formed by a first array, and a second layer of the array module 200*m* may be formed by a second array.

The processor 170 may adjust amounts of electrical energy supplied to the respective layers.

Figure 8:
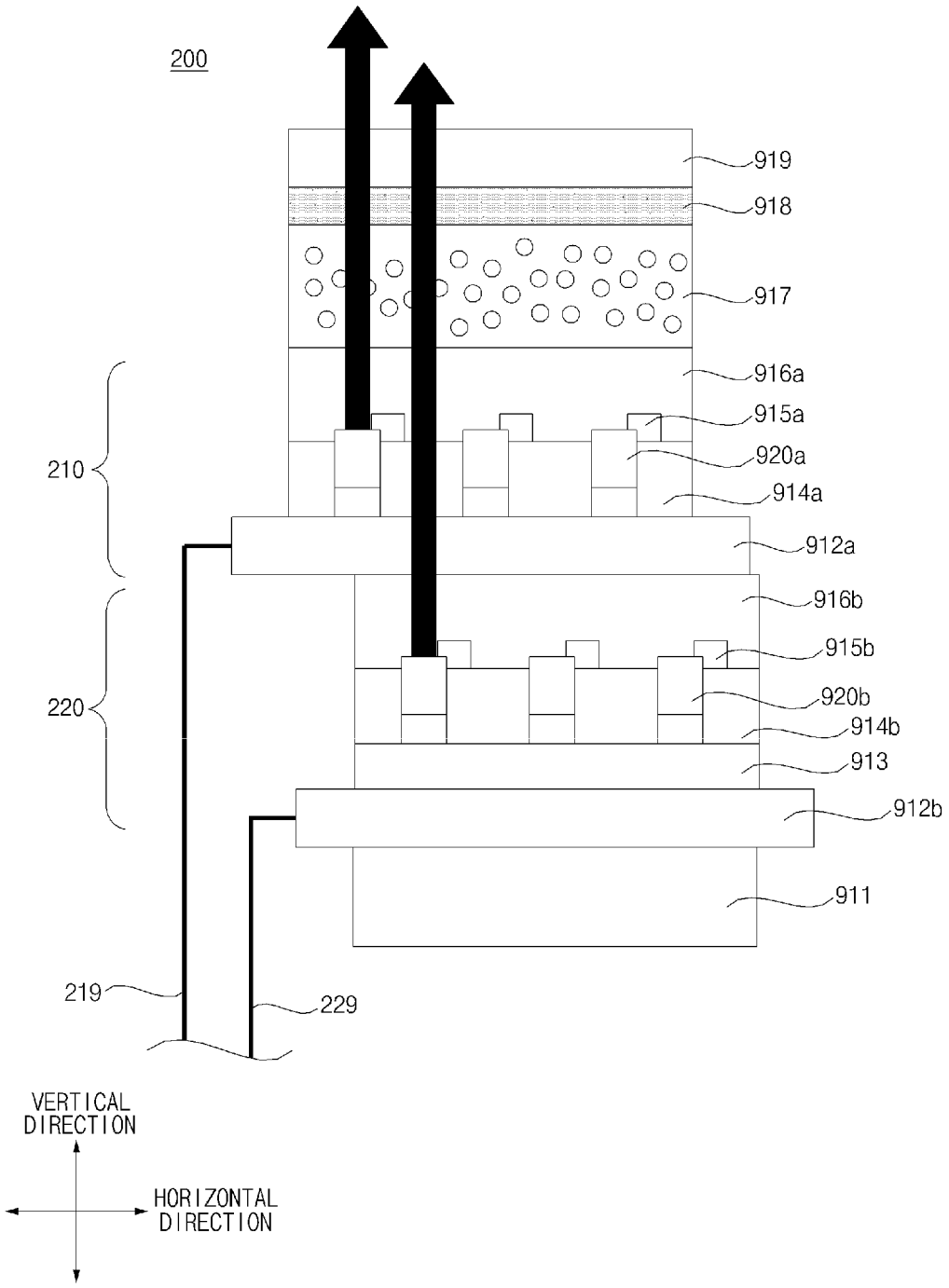
FIG. 8 is a reference cross-sectional view illustrating the array module provided with the micro-LED chips arranged therein, in accordance with the implementation.

FIG. 8 is a reference cross-sectional view illustrating the array module in accordance with the implementation.

Although FIG. 8 exemplarily illustrates the first array 210 and the second array 220 included in the array module 200*m*, the array module 200*m* may include three or more arrays.

With reference to FIG. 8, the array module 200*m* may include a polyimide layer 911, the first array 210 and the second array 220.

According to implementations, the array module 200*m* may further include a phosphor layer 917, a color filter film 918 and a cover film 919 individually or in combination.

The polyimide layer 911 may be formed to be flexible.

The second array 220 may be located on a base.

According to implementations, a layer formed by the polyimide layer 911 and a second anode 912*b* may be referred to as the base.

According to implementations, the polyimide layer 911 may be referred to as the base.

The second array 220 may be located between the first base 210 and the polyimide layer 911.

The second array 220 may include the second anode 912*b*, a reflective layer 913, a second interlayer dielectric film 914*b*, a second group of micro-LED chips 920*b*, a second optical spacer 916*b* and a second cathode 915*b*.

The second anode 912*b* may be a flexible copper clad laminate (FCCL). The second anode 912*b* may be formed of copper.

The second anode 912*b* and the second cathode 915*b* may be transmissive electrodes.

The second anode 912*b* and the second cathode 915*b* may be referred to as transparent electrodes.

The second array 220 may include transparent electrodes.

The second anode 912*b* and the second cathode 915*b* may include a metal, for example, any one selected from the group consisting of nickel (Ni), platinum (Pt), ruthenium (Ru), iridium (Ir), rhodium (Rh), tantalum (Ta), molybdenum (Mo), titanium (Ti), silver (Ag), tungsten (W), copper (Cu), chrome (Cr), palladium (Pd), vanadium (V), cobalt (C), niobium (Nb), zirconium (Zr), indium tin oxide (ITO), aluminum zinc oxide (AZO) and indium zinc oxide (IZO), or an alloy thereof.

The second anode 912*b* may be formed between the base 911 and the reflective layer 913.

The second cathode 915*b* may be formed on the second interlayer dielectric film 914*b*.

The reflective layer 913 may be formed on the second anode 912*b*. The reflective layer 913 may reflect light generated by the micro-LED chips 920. The reflective layer 913 may be formed of silver (Ag).

The second interlayer dielectric layer 914*b* may be formed on the reflective layer 913.

The second group of the micro-LED chips 920*b* may be formed on the second anode 912*b*. The micro-LED chips 920*b* of the second group may be adhered to the reflective layer 913 or the second anode 912*b* through solder or an anisotropic conductive film (ACF).

The second optical spacer 916*b* may be formed on the second interlayer dielectric film 914*b*. The second optical spacer 916*b* serves to maintain a distance between the second group of the micro-LED chips 920*b* and the first array 210 and may be formed of an insulating material.

The first array 210 may be formed on the second array 220.

The first array 210 may include a first anode 912*a*, a first interlayer dielectric film 914*a*, a first group of micro-LED chips 920*a*, a first optical spacer 916*a* and a first cathode 915*a*.

The first anode 912*a* may be a flexible copper clad laminate (FCCL). The first anode 912*a* may be formed of copper.

The first anode 912*a* and the first cathode 915*a* may be transmissive electrodes.

The first anode 912*a* and the first cathode 915*a* may be referred to as transparent electrodes.

The first array 210 may include transparent electrodes.

The first anode 912*a* and the first cathode 915*a* may include a metal, for example, any one selected from the group consisting of nickel (Ni), platinum (Pt), ruthenium (Ru), iridium (Ir), rhodium (Rh), tantalum (Ta), molybdenum (Mo), titanium (Ti), silver (Ag), tungsten (W), copper (Cu), chrome (Cr), palladium (Pd), vanadium (V), cobalt (C), niobium (Nb), zirconium (Zr), indium tin oxide (ITO), aluminum zinc oxide (AZO) and indium zinc oxide (IZO), or an alloy thereof.

The first anode 912*a* may be formed between the second optical spacer 916*b* and the first interlayer dielectric film 914*a*.

The first cathode 915*a* may be formed on the first interlayer dielectric film 914*a*.

The first interlayer dielectric layer 914*a* may be formed on the first anode 912*a*.

The first group of the micro-LED chips 920*a* may be formed on the first anode 912*a*. The micro-LED chips 920*a* of the first group may be adhered to the first anode 912*a* through solder or an anisotropic conductive film (ACF).

The first optical spacer 916*a* may be formed on the first interlayer dielectric film 914*a*. The first optical spacer 916*a* serves to maintain a distance between the first group of the micro-LED chips 920*a* and the phosphor layer 917 and may be formed of an insulating material.

The phosphor layer 917 may be formed on the first array 210 and the second array 220.

The phosphor layer 917 may be formed on the first optical spacer 916*a*. The phosphor layer 917 may be formed of a resin in which phosphors are uniformly dispersed. At least one of a blue phosphor, a blue-green phosphor, a green phosphor, a yellow-green phosphor, a yellow phosphor, a yellow-red phosphor, an orange phosphor and a red phosphor may be used according to the wavelength of light emitted by the micro-LED chips 920*a* and 920*b* of the first and second groups.

The phosphor layer 917 may change the wavelength of light emitted by the first and second groups of the micro-LED chips 920*a* and 920*b*.

The phosphor layer 917 may change the wavelength of first beams generated by the first group of the micro-LED chips 920*a* and the wavelength of second beams generated by the second group of the micro-LED chips 920*b*.

The color filter film 918 may be formed on the phosphor layer 917. The color filter film 918 may implement a designated color in light passed through the phosphor layer 917. The color filter film 918 may implement at least one of red (R), green (G) and blue (B), or a color formed by a combination thereof.

The cover film 919 may be formed on the color filter film 918. The cover film 919 may protect the array module 200*m*.

The micro-LED chips 920*b* included in the second array 220 may be arranged so as not to overlap the micro-LED chips 920*a* in the first array 210 in the vertical direction or in the horizontal direction.

The micro-LED chips 920*a* included in the second group may be arranged so as not to overlap the micro-LED chips 920*a* included in the first group in the vertical direction or in the horizontal direction.

Here, the vertical direction may be a direction in which the first and second arrays 210 and 220 of the array module 200*m* are stacked.

The first and second groups of micro-LED chips 920*a* and 920*b* may output light in the vertical direction.

The horizontal direction may be a direction in which the first and second groups of the micro-LED chips 920*a* and 920*b* are arranged.

The horizontal direction may be a direction in which the polyimide layer 911, the first and second anodes 912*a* and 912*b* or the phosphor layer 917 is extended.

The vehicle lamp 100 may further include wirings to supply power to the array module 200*m*.

For example, the vehicle lamp 100 may further include first wirings 219 and second wirings 229.

The first wirings 219 may supply power to the first array 210. A pair of first wirings 219 may be provided. The first wirings 219 may be connected to the first anode 912*a* and/or the first cathode 915*a*.

The second wirings 229 may supply power to the second array 220. A pair of second wirings 229 may be provided.

The second wirings 229 may be connected to the second anode 912*b* and/or the second cathode 915*b*.

The first wirings 219 and the second wirings 229 may be arranged so as not to overlap each other.

Figure 9:
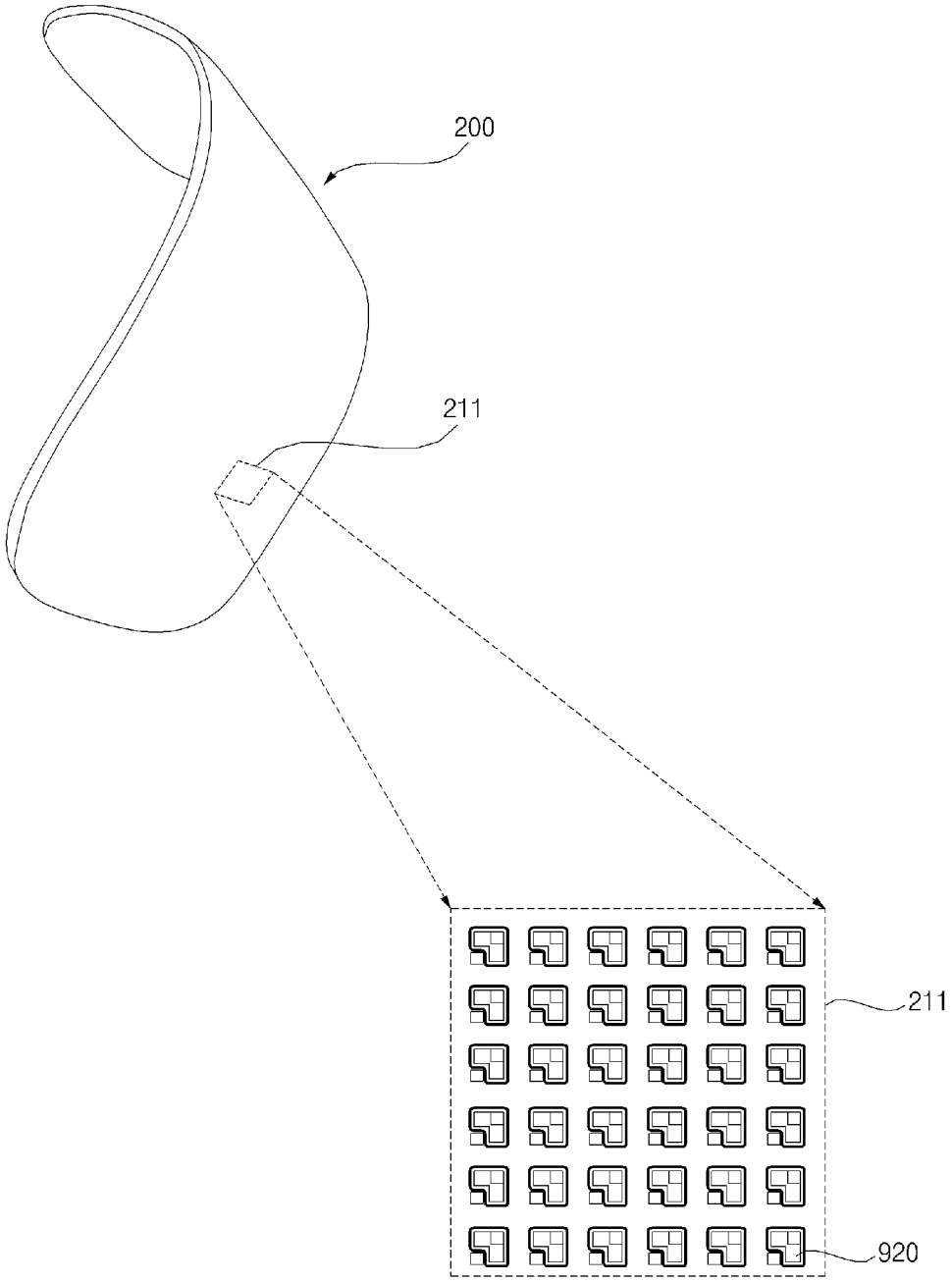
FIG. 9 is a view exemplarily illustrating an overall external appearance of an array in accordance with one implementation.

FIG. 9 is a view exemplarily illustrating an overall external appearance of an array in accordance with one implementation.

Figure 10A:
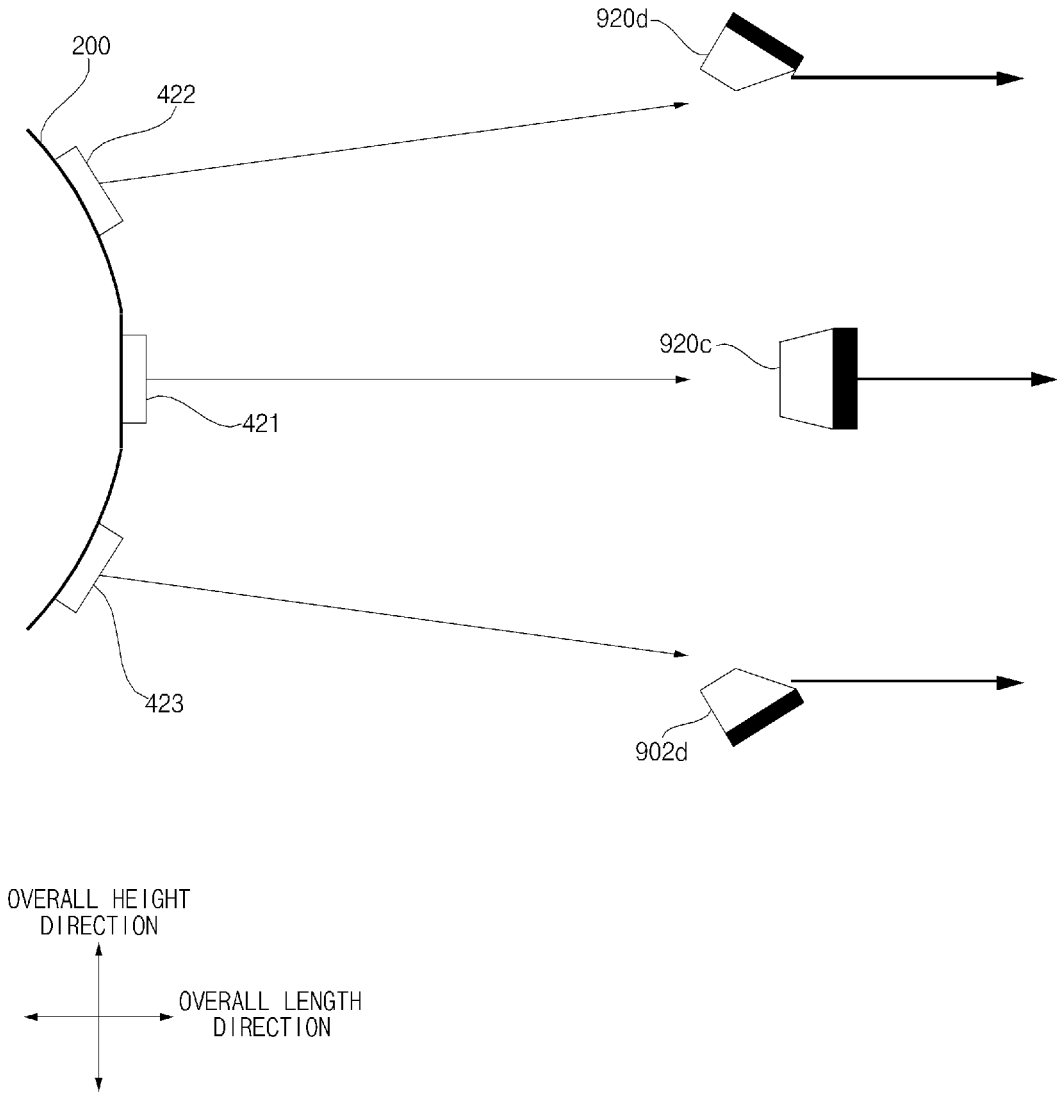
Figure 10B:
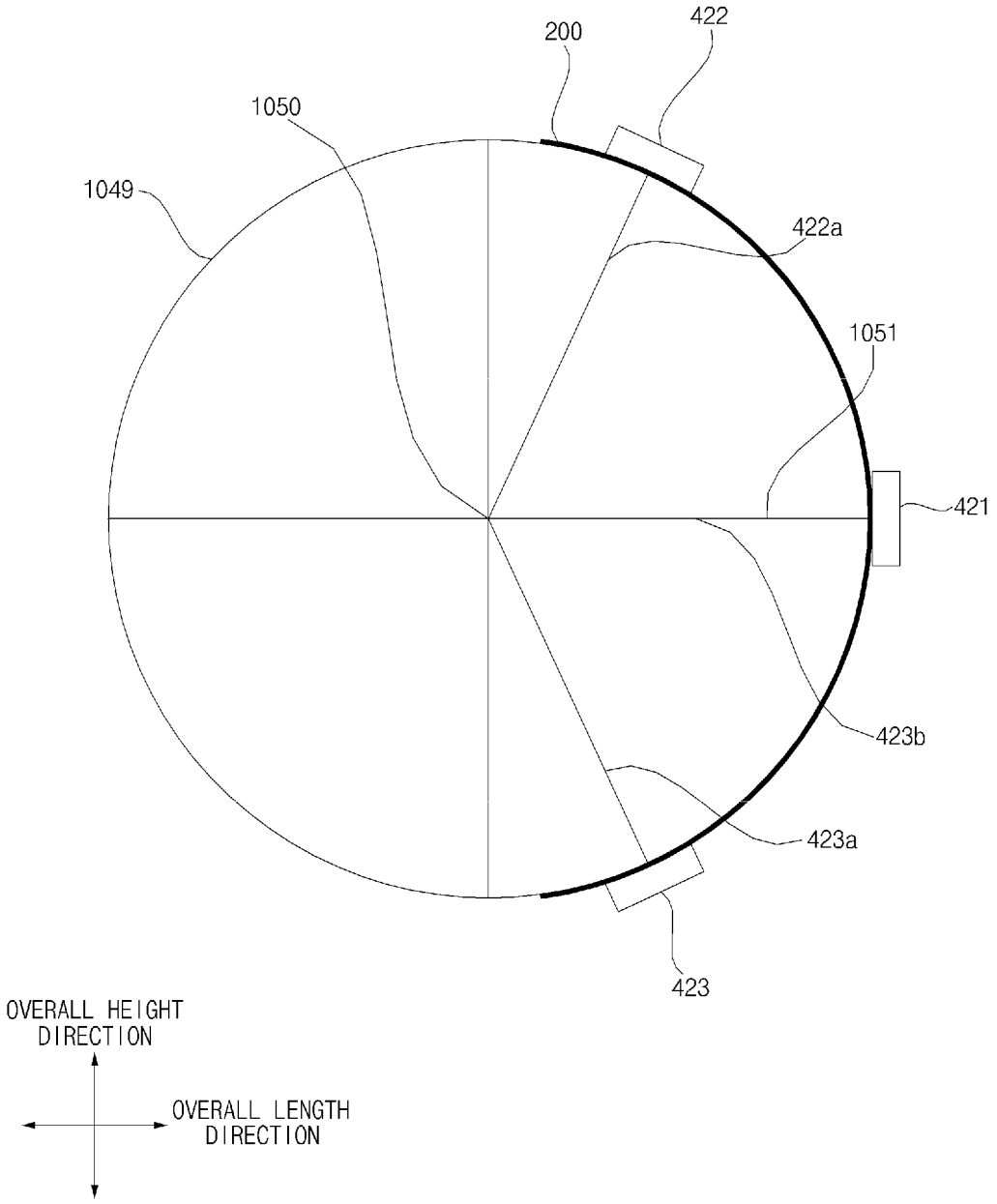

FIGS. 10A and 10B are schematic views briefly illustrating the array and micro-LED chips in accordance with the implementation. FIGS. 10A and 10B are side views.

With reference to FIG. 9 and FIGS. 10A and 10B, a plurality of groups of micro-LED chips 920*c* and 920*d* may be arranged in the array 200.

The micro-LED chips 920*c* and 920*b* of the respective groups may have different shapes.

As exemplarily shown in FIG. 10A, the array 200 may be bent so as to have a plurality of curvature values according to regions.

The array 200 may be divided into a plurality of regions 421, 422 and 423.

The array 200 may be divided into the regions 421, 422 and 423 according to curvature values.

The array 200 may include a first region 421, a second region 422 and a third region 423.

The first region 421 may be a bending region having a first curvature value.

The second region 422 may be a bending region having a second curvature value. The second curvature value may be greater than the first curvature value.

The third region 423 may be a bending region having a third curvature value. The third curvature value may be greater than the first curvature value.

Here, the curvature value may be defined as a reciprocal of the radius of a circle contacting the inner bent surface of the array 200 (opposite the surface of the array 200 outputting light) when the array 200 is bent.

Otherwise, the curvature value may be described as a degree of bending of the array 200.

For example, if the curvature value of one region of the array 200 is 0, the region may be flat.

The micro-LED chips 920*c* and 920*d* arranged in the respective regions 421, 422 and 423 may have different shapes.

A first group of micro-LED chips 920*c* having a first shape may be arranged in the first region 421. The micro-LED chip 920*c*, having the first shape, of the first group will be described later with reference to FIG. 11A.

A second group of micro-LED chips 920*d* having a second shape may be arranged in the second region 422. The micro-LED chip 920*d*, having the second shape, of the second group will be described later with reference to FIGS. 11B and 11C.

A third group of micro-LED chips 920*d* having the second shape may be arranged in the third region 423. The micro-LED chip 920*d*, having the second shape, of the third group will be described later with reference to FIGS. 11B and 11C. The micro-LED chips of the third group may be top-and-bottom symmetrical with the micro-LED chips of the second group.

As exemplarily shown in FIG. 10B, the array 200 may be bent so as to have a constant curvature value.

The array 200 may be bent so as to contact a virtual circle 1049 in the overall height direction, as seen from the side. In this case, the array 200 may have an arc-shaped cross-section. Here, the curvature value of the array 200 may be a reciprocal of the radius of the virtual circle 1049.

The array 200 may be divided into a plurality of regions 421, 422 and 423.

The array 200 may be divided into the regions 421, 422 and 423 according to positions.

The array 200 may be divided based on an angle range formed between a virtual line connecting a center 1050 of the virtual circle 1049 to the array 200 and a line 1051 passing through the center 1050 of the virtual circle 1049 and being parallel to a horizontal plane in a clockwise direction or a counterclockwise direction.

Here, the clockwise direction from the line 1051 passing through the center 1050 of the virtual circle 1049 and being parallel to the horizontal plane is defined as "+", and the counterclockwise direction from the line 1051 is defined as "−".

The flexible array 200 may include a first region 421, a second region 422 and a third region 423.

The first region 421 may be a region having a first angle range. The first angle range may be a range between +70 degrees and −70 degrees.

The second region 422 may be a region having a second angle range. The second angle range may be a range between +70 degrees and +90 degrees.

The third region 423 may be a region having a third angle range. The third angle range may be a range between −70 degrees and −90 degrees.

The micro-LED chips 920*c* and 920*d* arranged in the respective regions 421, 422 and 423 may have different shapes.

A first group of micro-LED chips 920*c* having a first shape may be arranged in the first region 421. The micro-LED chip 920*c*, having the first shape, of the first group will be described later with reference to FIG. 11A.

A second group of micro-LED chips 920*d* having a second shape may be arranged in the second region 422. The micro-LED chip 920*d*, having the second shape, of the second group will be described later with reference to FIGS. 11B and 11C.

A third group of micro-LED chips 920*d* having the second shape may be arranged in the third region 423. The micro-LED chip 920*d*, having the second shape, of the third group will be described later with reference to FIGS. 11B and 11C. The micro-LED chips of the third group may be top-and-bottom symmetrical with the micro-LED chips of the second group.

Output directions of beams generated by the groups of the micro-LED chips 920*c* and 920*d* may be different.

For example, when the micro-LED chips 920*c* and 920*d* are placed on the same plane, the output directions of beams generated by the respective micro-LED chips 920*c* and 920*d* may be different.

Figure 11A:
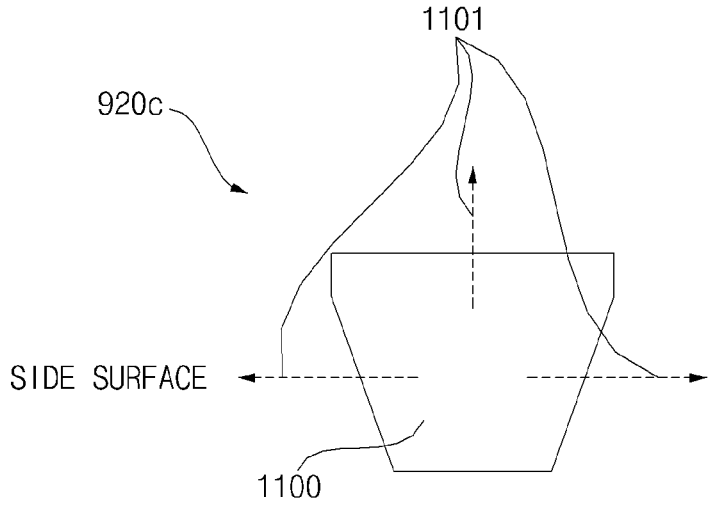
FIGS. 11A to 11C are reference views illustrating shapes of the micro-LED chips in accordance with the implementation.
Figure 11A:
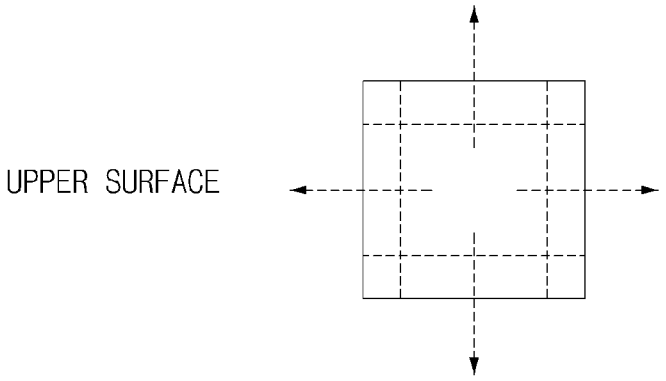
Figure 11B:
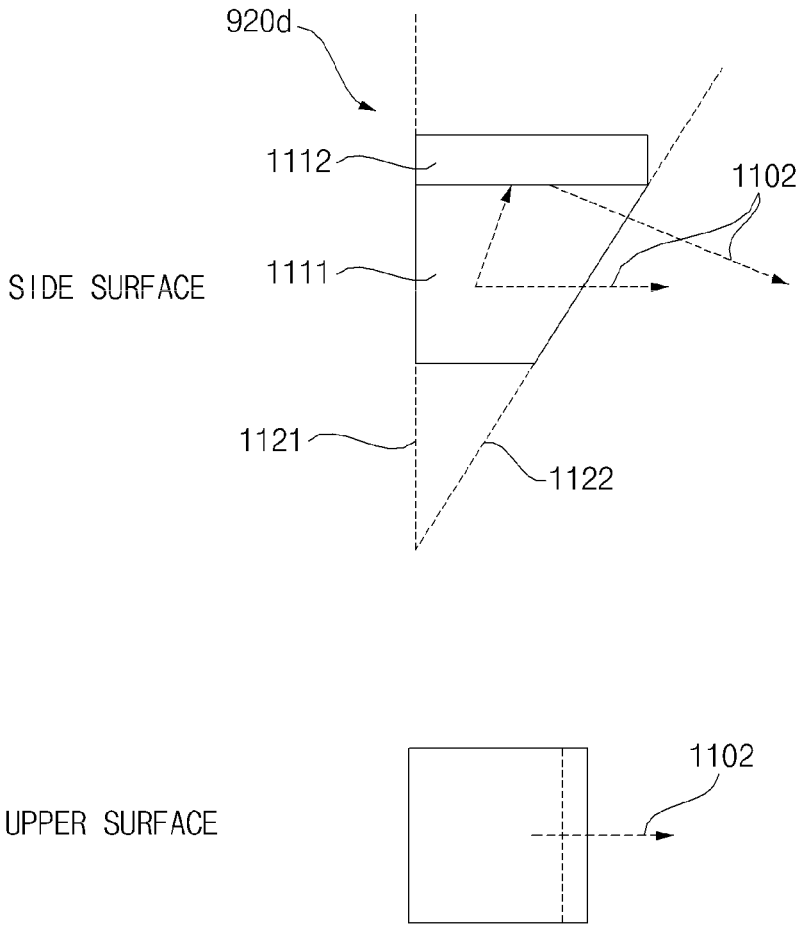
Figure 11C:
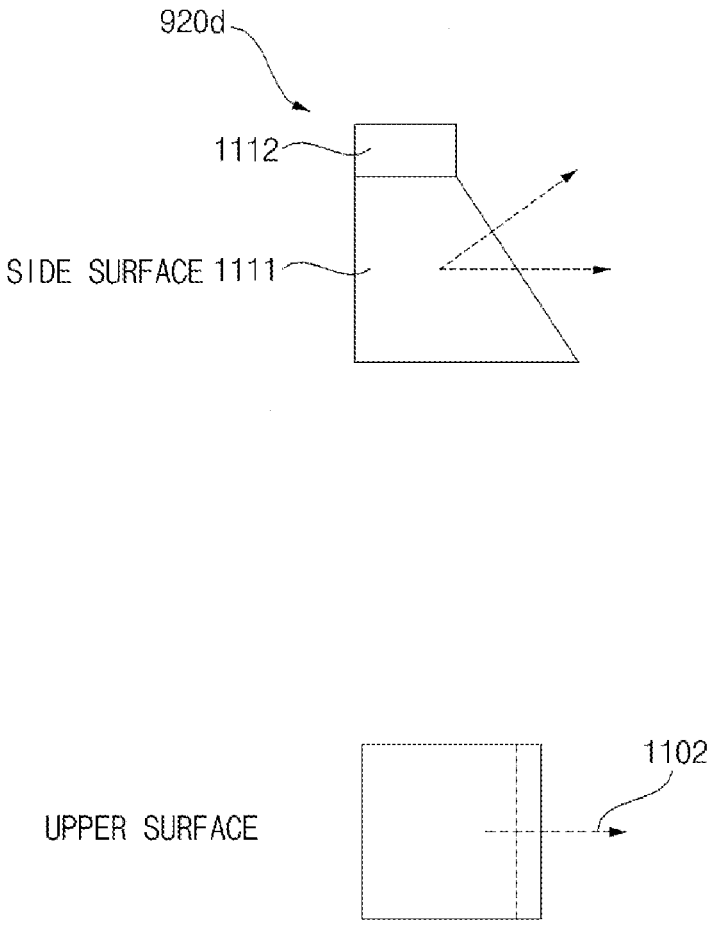

FIGS. 11A to 11C are reference views illustrating shapes of the micro-LED chips in accordance with the implementation.

FIG. 11A schematically illustrates the micro-LED chip 920*c*, having the first shape, of the first group shown in FIGS. 10A and 10B.

With reference to FIG. 11A, the micro-LED chip 920*c*, having the first shape, of the first group (hereinafter, referred to as a first micro-LED chip) may have a general shape.

The first micro-LED chip 920*c* may include a main body 1100.

The main body 1100 may include a p-n diode layer. The p-n diode layer may include a first type semiconductor layer (for example, a p-doped layer), an active layer and a second type semiconductor layer (for example, an n-doped layer).

As seen from the side, the main body 1100 of the first micro-LED chip 920*c* may have a trapezoidal shape in which a top side is longer than a bottom side. The vertical cross-section of the main body 1100 may be bilaterally symmetrical.

As seen from the top, the main body 1100 of the first micro-LED chip 920*c* may have a rectangular shape.

The first micro-LED chip 920*c* may output beams 1101 upward and sideward. The first micro-LED chip 920 may output beams 1101 in the upward direction and in four directions, i.e., the frontward, rearward, leftward and rightward directions.

FIG. 11B schematically illustrates the micro-LED chip 920*d*, having the second shape, of the second group shown in FIGS. 10A and 10B.

With reference to FIG. 11B, the micro-LED chip 920*d*, having the second shape, of the second group (hereinafter, referred to as a second micro-LED chip) may have a different shape from the first micro-LED chip 920*c*.

The second micro-LED chip 920*d* may include a main body 1111 and a reflective layer 1112.

The main body 1111 may include a p-n diode layer. The p-n diode layer may include a first type semiconductor layer (for example, a p-doped layer), an active layer and a second type semiconductor layer (for example, an n-doped layer).

The horizontal cross-sectional area of the main body 1111 may be gradually increased in a direction towards the reflective layer 1112.

The vertical cross-section of the main body 1111 may be bilaterally asymmetrical.

A side surface 1122 of the main body 1111 may have a gradient in a direction 1121 perpendicular to the reflective layer 1112. The side surface 1122 of the main body 1111 may form an acute angle with the reflective layer 1112.

The gradient formed by the side surface 1122 of the main body 1111 in the direction 1121 perpendicular to the reflective layer 111 may be determined based on the second curvature value.

For example, as the second curvature value is increased, the gradient may be gradually increased.

For example, as the second curvature value is decreased, the gradient may be gradually decreased.

The reflective layer 1112 may be located on the main body 1111.

The reflective layer 1112 may reflect beams generated by the main body 1111. The reflective layer 1112 may be formed of silver (Ag).

As seen from the top, the main body 1111 of the second micro-LED chip 920*d* may have a rectangular shape.

The second micro-LED chip 920*d* may concentratedly output beams 1102 in one direction.

For example, if the vehicle lamp 100 functions as the rear combination lamp 100*b*, the second micro-LED chip 920*d* may concentratedly output beams 1102 in the rearward direction of the vehicle 10.

FIG. 11B schematically illustrates another micro-LED chip 920*d*, having the second shape, of the second group shown in FIGS. 10A and 10B.

The second micro-LED chip 920*d* of FIG. 11C may have a different shape from the second micro-LED chip 920*d* of FIG. 11B.

The second micro-LED chip 920*d* may include a main body 1111 and a reflective layer 1112.

The horizontal cross-sectional area of the main body 1111 may be gradually decreased in a direction towards the reflective layer 1112.

The vertical cross-section of the main body 1111 may be bilaterally asymmetrical.

A side surface 1122 of the main body 1111 may have a gradient in a direction 1121 perpendicular to the reflective layer 1112. The side surface 1122 of the main body 1111 may form an obtuse angle with the reflective layer 1112.

Figure 12A:
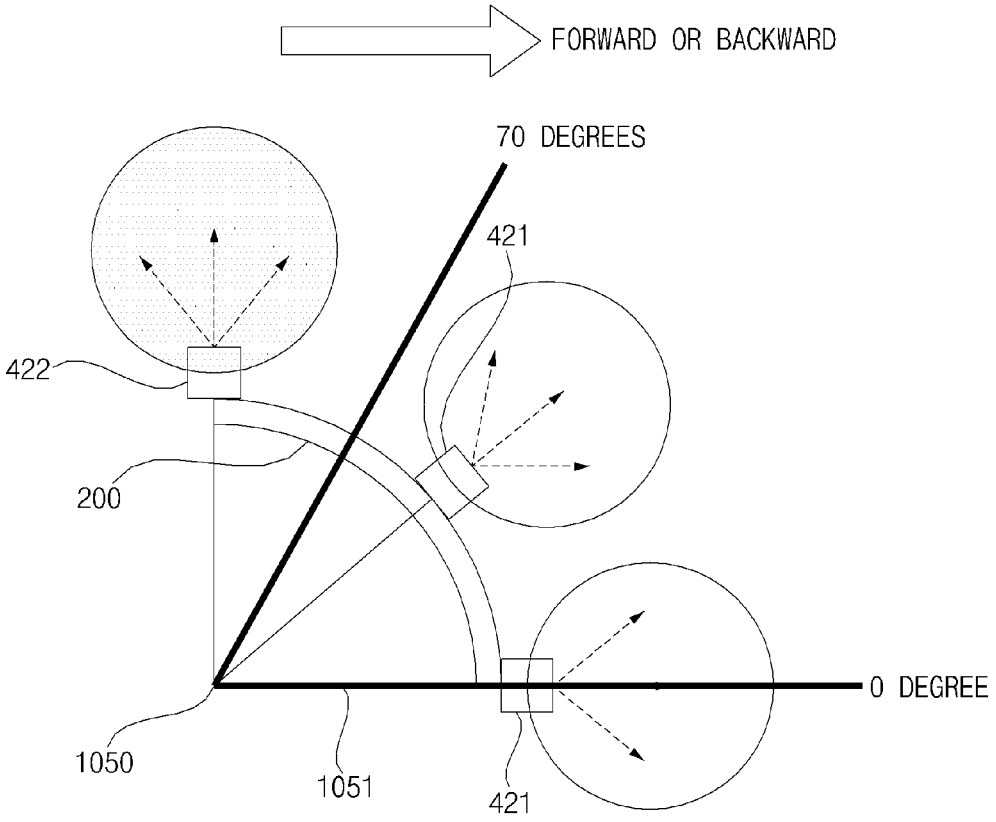
FIGS. 12A and 12B are reference views illustrating a plurality of groups of micro-LEDs arranged in arrays in accordance with implementations of the present disclosure.
Figure 12A:
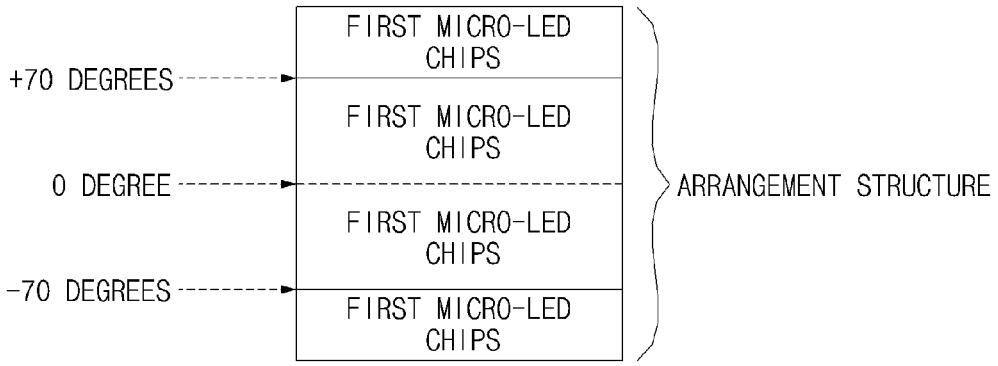
Figure 12B:
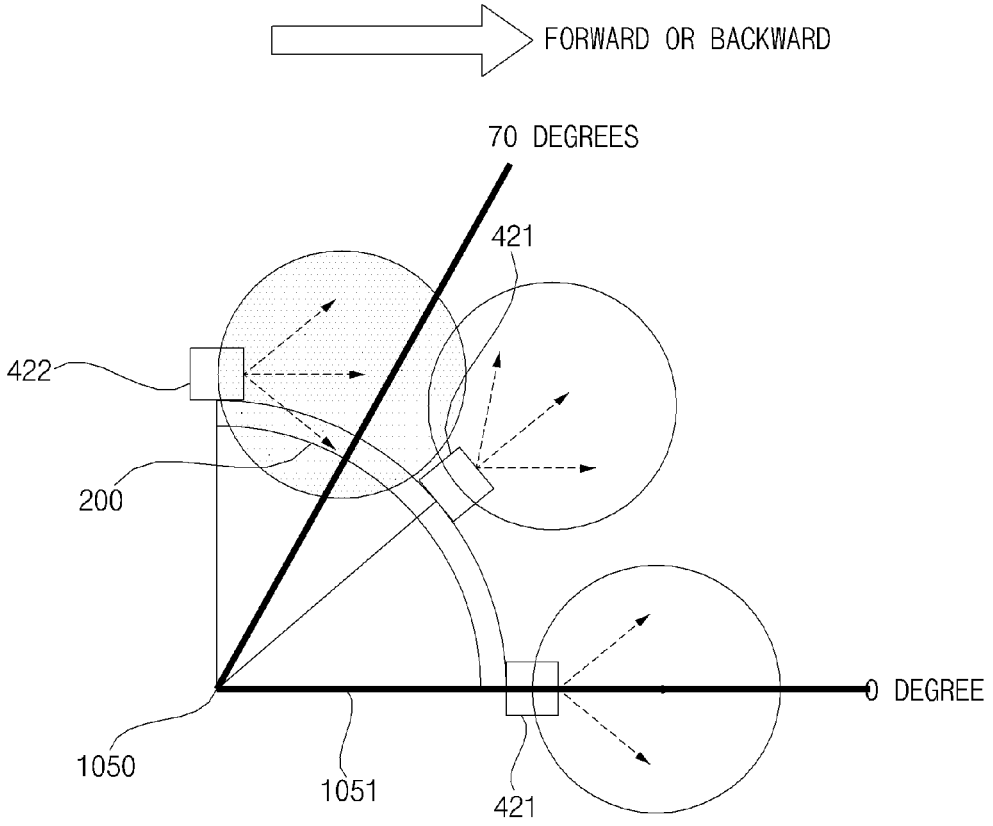
Figure 12B:
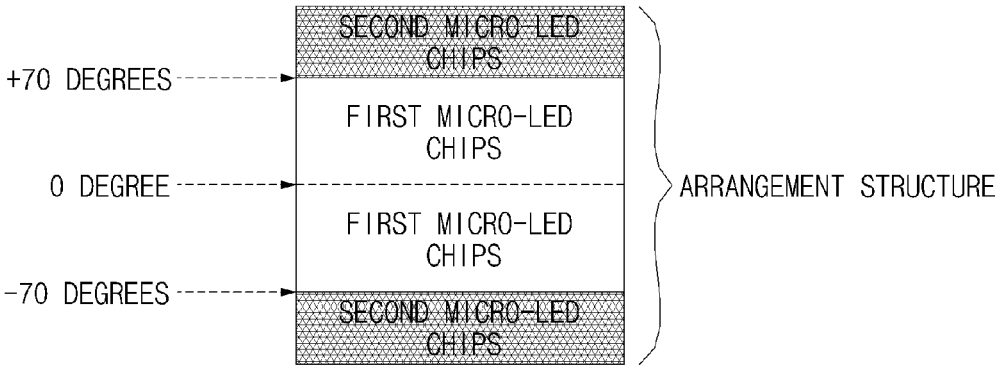

FIGS. 12A and 12B are reference views illustrating a plurality of groups of micro-LEDs arranged in arrays in accordance with implementations of the present disclosure.

As described above with reference to FIG. 10B, an array 200 may be bent so as to have a constant curvature value.

The array 200 may include a plurality of regions 421 and 422.

The regions 421 and 422 may be divided from each other according to positions thereof on the array 200.

For example, a first region 421 may be a region having an angle range of +70 degrees to −70 degrees, formed between a virtual line connecting a center 1050 of a virtual circle to the array 200 and a line 1051 passing through the center 1050 of the virtual circle and being parallel to a horizontal plane, as seen from the side.

For example, second regions 422 may be a region having an angle range of +70 degrees to +90 degrees and a region having an angle range of −70 degrees to −90 degrees, formed between the virtual line connecting the center 1050 of the virtual circle to the array 200 and the line 1051 passing through the center 1050 of the virtual circle and being parallel to the horizontal plane, as seen from the side.

As exemplarily shown in FIG. 12A, the first micro-LED chips 920*c* may be arranged in both first and second regions 421 and 422.

Otherwise, as exemplarily shown in FIG. 12B, the first micro-LED chips 920*c* may be arranged in the first region 421 and the second micro-LED chips 902*d* may be arranged in the second region 422.

If the vehicle lamp 100 functions as the rear combination lamp 100*b*, light concentration in the rearward direction of the vehicle 10 must be increased.

In a vehicle lamp 100 including the array 200 of FIG. 12A, the first micro-LED chips 920*c* are located in the second regions 422, and beams are distributed in the upward and downward directions of the vehicle 10 and, thus, light concentration in the rearward direction is lowered.

In a vehicle lamp 100 including the array 200 of FIG. 12B, the second micro-LED chips 920*d* are located in the second regions 422, beams may be concentrated in the rearward direction of the vehicle 10. Further, uniformity in intensity of light is increased and color deviation is reduced.

If the vehicle lamp 100 functions as the head lamp 100*a* or the fog lamp 100*c*, light concentration in the forward direction of the vehicle 10 must be increased.

In a vehicle lamp 100 including the array 200 of FIG. 12A, the first micro-LED chips 920*c* are located in the second regions 422, beams are distributed in the upward and downward directions of the vehicle 10 and, thus, light concentration in the forward direction is lowered.

In a vehicle lamp 100 including the array 200 of FIG. 12B, the second micro-LED chips 920*d* are located in the second regions 422, beams may be concentrated in the forward direction of the vehicle 10. Further, uniformity in intensity of light is increased and color deviation is reduced.

Figure 13A:
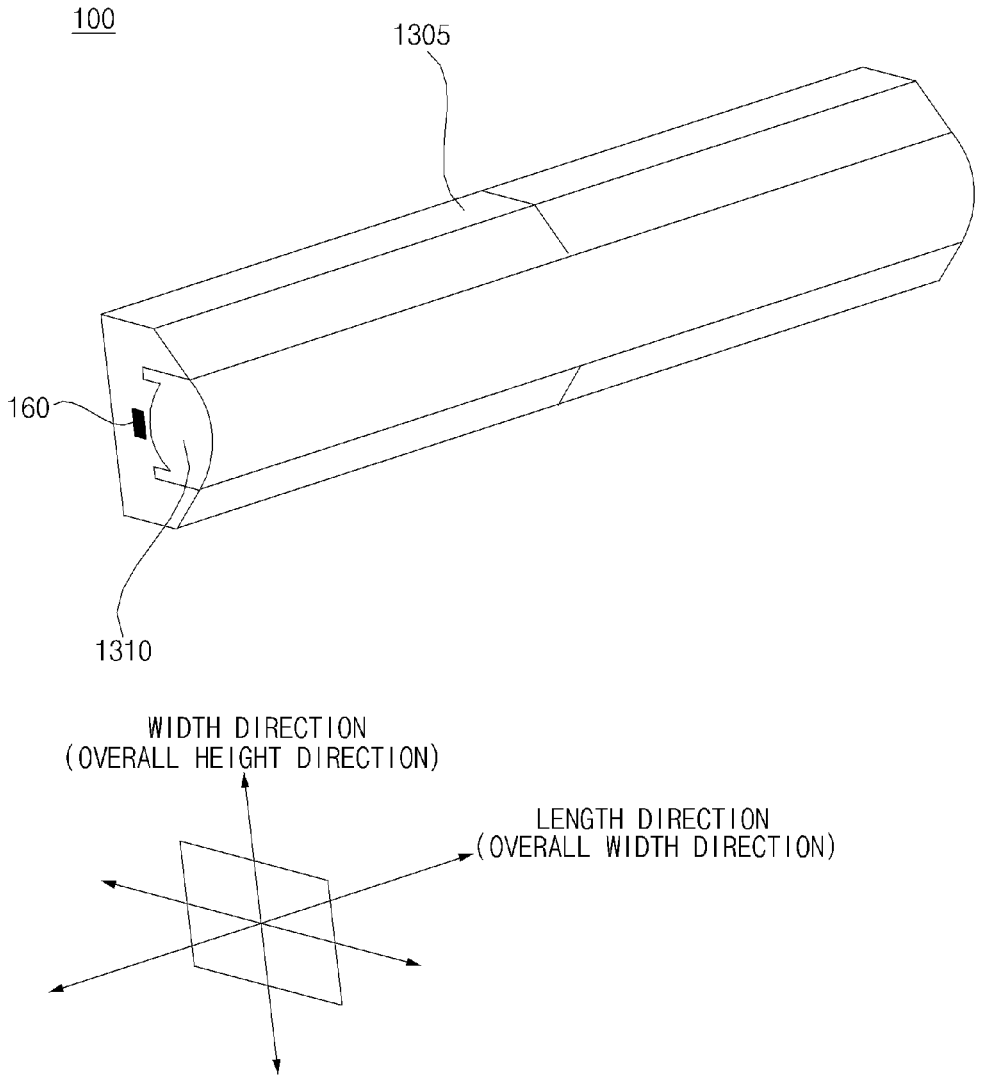
FIG. 13A is a view exemplarily illustrating an external appearance of a lamp for vehicles in accordance with one implementation.

FIG. 13A is a view exemplarily illustrating an external appearance of a vehicle lamp in accordance with one implementation.

With reference to FIG. 13A, the vehicle lamp 100 may further include a main body 1305 and a lens 1310.

The main body 1305 may extend in a first direction. The first direction may be defined as a length direction of the main body 1305, as denoted in FIG. 13A.

For example, the main body 1305 may extend in the overall width direction. In this case, the overall width direction may be defined as the length direction of the main body 1305 (the first direction). The overall width direction may be described as the leftward and rightward directions.

For example, the main body 1305 may extend in the overall height direction. In this case, the overall height direction may be defined as the length direction of the main body 1305. The overall height direction may be described as the upward and downward directions.

The main body 1305 may receive the light generation unit 160.

The lens 1310 may be combined with a part of the main body 1305 under the condition that the main body 1305 receives the light generation unit 160.

The lens 1310 may cover the light generation unit 160.

The lens 1310 may be disposed in front of or at the rear of the light generation unit 160. Here, the forward direction may be defined as the forward driving direction of the vehicle 10, and the rearward direction may be defined as the reversing direction of the vehicle.

For example, if the vehicle lamp 100 functions as the daytime running lamp 100*a*, the lens 1310 may be disposed in front of the light generation unit 160.

For example, if the vehicle lamp 100 functions as the tail lamp 100*b* or the brake lamp, the lens 1310 may be disposed at the rear of the light generation unit 160.

The lens 1310 may extend in the same direction as the main body 1305. Using the notation above, the lens 1310 may extend in the first direction, defined as the length direction of the lens 1310 in FIG. 13A.

For example, the lens 1310 may extend in the overall width direction. In this case, the overall width direction may be defined as the length direction of the lens 1310 (the first direction). The overall width direction may be described as the leftward and rightward directions.

For example, the lens 1310 may extend in the overall height direction. In this case, the overall height direction may be defined as the length direction of the lens 1310 (the first direction). The overall height direction may be described as the upward and downward directions.

The lens 1310 may be configured to change a path of beams generated by the light generation unit 160.

The array 200 may be received in the main body 1305. For example, the lens 1310 is combined with the main body 1305 under the condition that the array 200 is received in the main body 1305 and, thus, the array 200 may be sealed by the main body 1305 and the lens 1310.

Figure 13B:
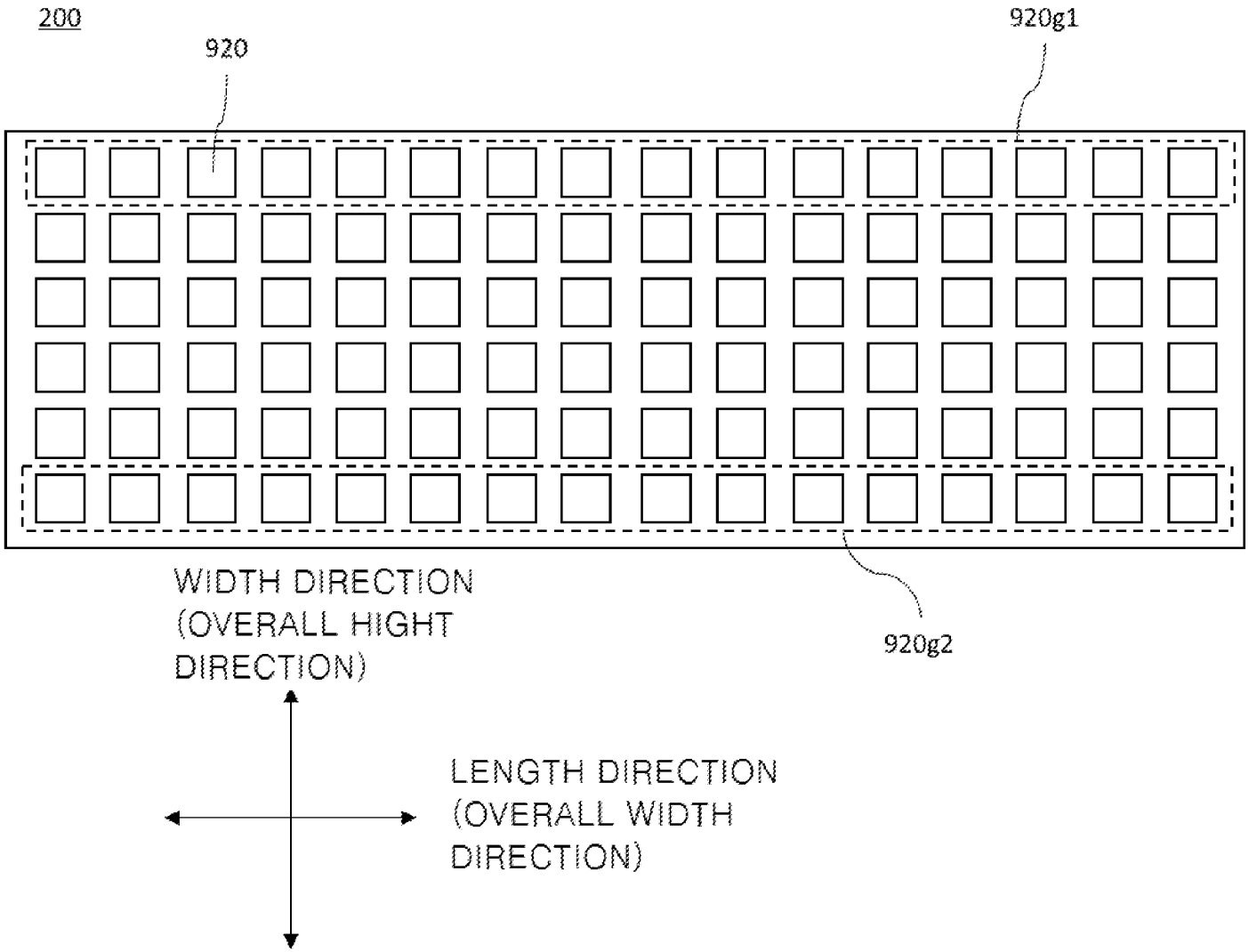
FIG. 13B is a view exemplarily illustrating an array in accordance with one implementation.

FIG. 13B is a view exemplarily illustrating an array in accordance with one implementation With reference to FIG. 13B, the array 200 may extend in the same direction as the main body 1305 and the lens 1310. The array 200 may extend in the first direction. The first direction may be defined as the length direction of the array 200.

For example, the array 200 may extend in the overall width direction. In this case, the overall width direction may be defined as the length direction of the array 200 (the first direction). The overall width direction may be defined as the leftward and rightward directions.

For example, the array 200 may extend in the overall height direction. In this case, the overall height direction may be defined as the length direction of the array 200 (the first direction). The overall height direction may be defined as the upward and downward directions.

The array 200 may include a plurality of groups of micro-LED chips.

The array 200 may include a first group of micro-LED chips 920*g*1 and a second group of micro-LED chips 920*g*2.

The first group of micro-LED chips 920*g*1 may be arranged in a line in the first direction at the uppermost portion of the array 200.

The second group of micro-LED chips 920*g*2 may be arranged in a line in the first direction at the lowermost portion of the array 200.

The array 200 may further include one or more groups of micro-LED chips in addition to the first and second groups of micro-LED chips 920*g*1 and 920*g*2.

The various groups of micro-LED chips in the array 200 may collectively output a collection of beams. The collection of beams output from the array 200 may extend from an uppermost beam to a lowermost beam. For example, the uppermost beam may be an uppermost beam generated by the first group of micro-LED chips 920*g*1. The lowermost beam may be a lowermost beam generated by the second group of micro-LED chips 920*g*2.

The array 200 may have a divergence angle formed by uppermost and lowermost beams that are output from the array 200.

In some implementations, the divergence angle of the array 200 may be formed in a second direction. The second direction may be defined as a direction perpendicular to the first direction. Further, the second direction may be defined as a direction perpendicular to an optical axis of beams generated by the array 200.

The divergence angle of the array 200 formed in the second direction may be defined by beams generated by the first group of micro-LED chips 920*g*1 and the second group of micro-LED chips 920*g*2.

Further details of the divergence example are given below in relation to FIGS. 14 and 15.

Figure 14:
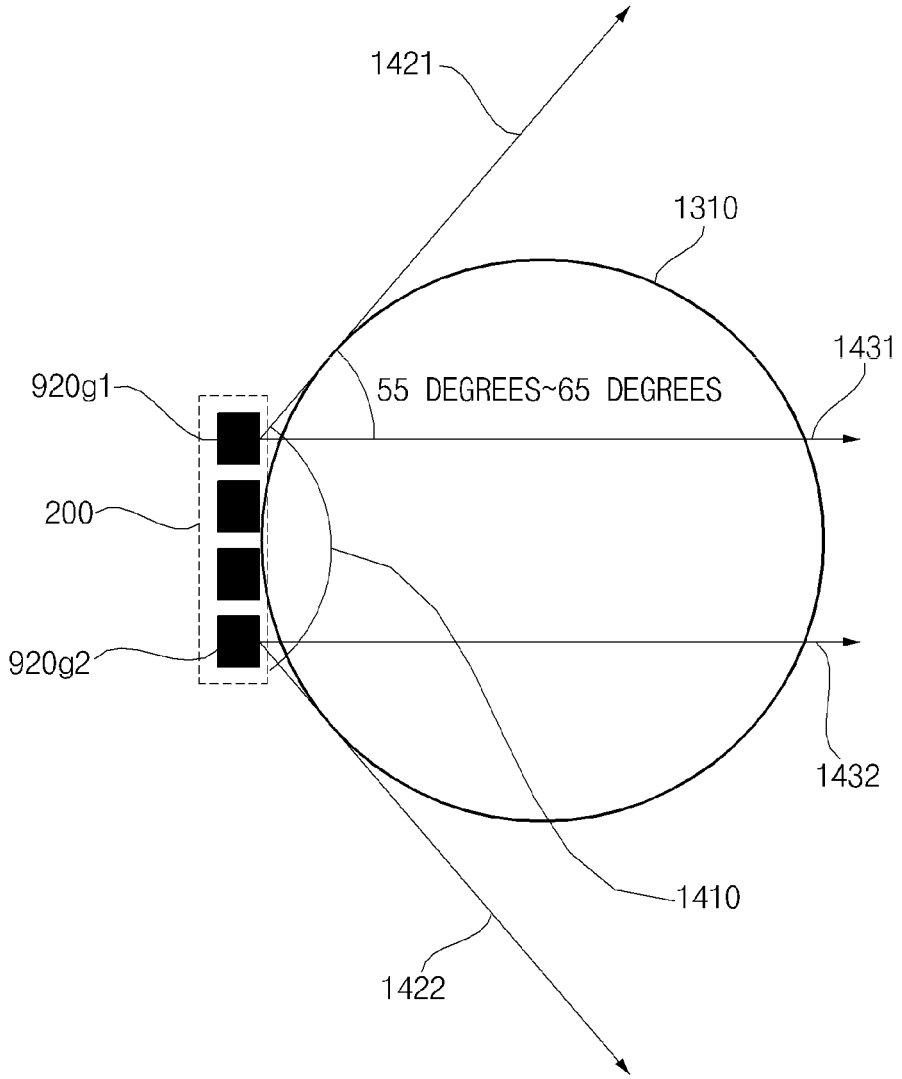
FIG. 14 is a cross-sectional view of a lamp for vehicles in accordance with one implementation.

FIG. 14 is a cross-sectional view of a vehicle lamp in accordance with one implementation.

FIG. 14 schematically illustrates only the array 200 and the lens 1310 in the cross-sectional view of the vehicle lamp 100 of FIG. 13A, taken along a first plane 1391.

As shown in the example of FIG. 14, the array 200 may output beams having a divergence angle 1410 between uppermost and lowermost beams.

The lens 1310 may be arranged to be inscribed within the divergence angle 1410. As such, beams that are output from the array 200 within this divergence angle 1410 are redirected by the lens 1310.

Figure 15:
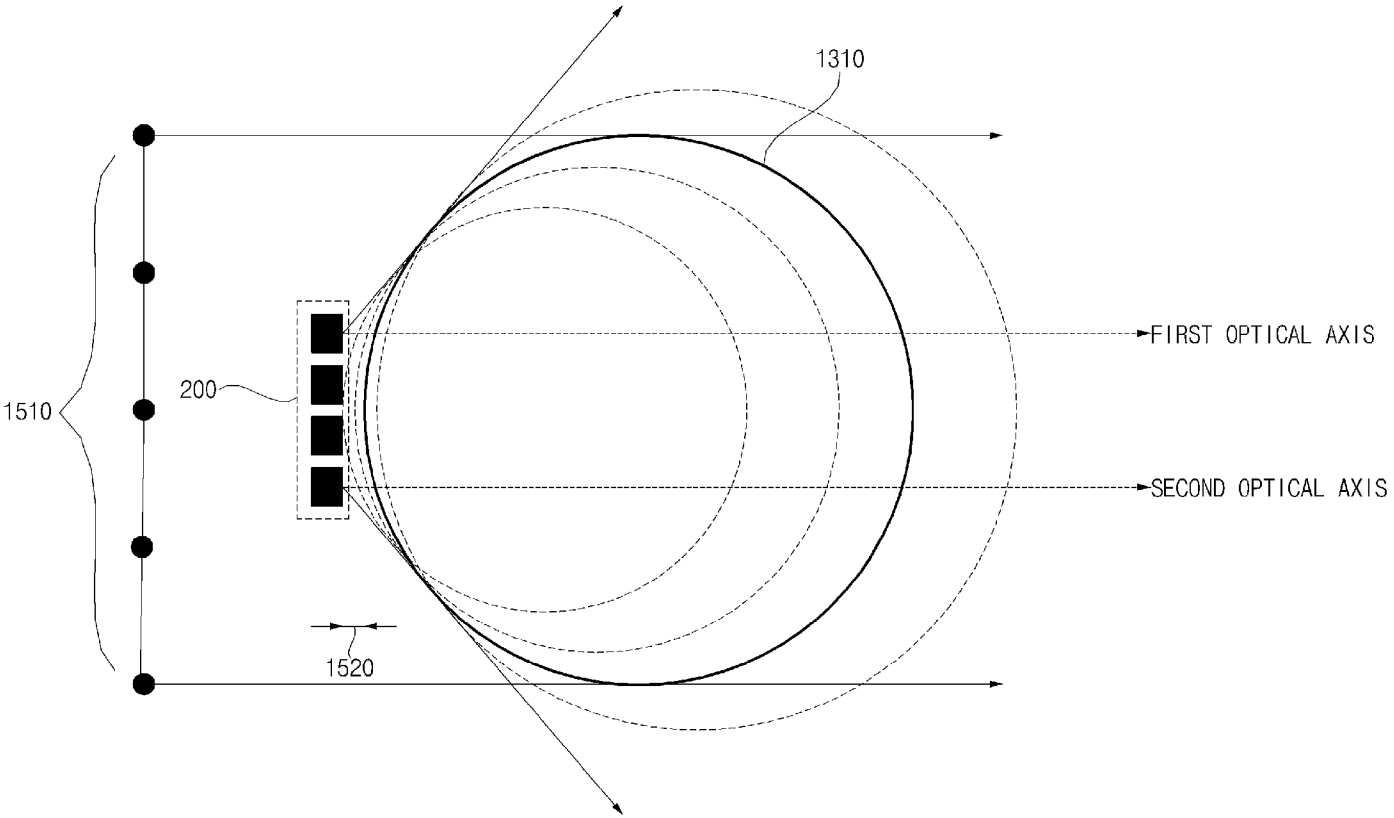
FIG. 15 is a cross-sectional view of a lamp for vehicles in accordance with another implementation.

In some implementations, the vertical cross-section of the lens 1310 may have a circular or oval shape, as shown in FIGS. 14 and 15. The largest such vertical cross-section of the lens 1310 (e.g., the vertical cross-section through a center part of the lens) may be inscribed within the divergence angle 1410, in the vertical direction, of beams output from the array 200.

The divergence angle 1410 may be defined by first beams output from the first group of micro-LED chips 920*g*1 and second beams output from the second group of micro-LED chips 920*g*2.

The first group of micro-LED chips 920*g*1 may be arranged in a line in the overall width direction at the uppermost portion of the array 200.

The second group of micro-LED chips 920*g*2 may be arranged in a line in the overall width direction at the lowermost portion of the array 200.

The divergence angle 1410 may be defined as an angle 1410 in the upward and downward directions (or in the overall height direction) formed by the uppermost portion of the first beam output range and the lowermost portion of the second beam output range.

The vertical cross-section of the lens 1310 may be inscribed in the divergence angle 1410. For example, the vertical cross-section of the lens 1310 may be inscribed in a first plane 1421 and a second plane 1422 defined by the beams output from the array 200.

The vertical cross-section of the lens 1310 may contact the first plane 1421 having an angle in the upward direction with a first optical axis 1431 extending from the first group of micro-LED chips 920*g*1 so as to be perpendicular to the array 200.

Beams generated by the first group of micro-LED chips 920*g*1 may form the first plane 1421.

The first plane 1421 may be defined as a plane generated by uniting uppermost parts of beams generated by the respective micro-LED chips 920 of the first group of micro-LED chips 920*g*1.

In some implementations, the vertical cross-section of the lens 1310 may contact the first plane 1421 having an angle of 55 to 65 degrees in the upward direction with the first optical axis 1431 extending from the first group of micro-LED chips 920*g*1 so as to be perpendicular to the array 200.

The vertical cross-section of the lens 1310 may contact the second plane 1422 having an angle b in the downward direction with a second optical axis 1432 extending from the second group of micro-LED chips 920*g*2 so as to be perpendicular to the array 200.

Beams generated by the second group of micro-LED chips 920*g*2 may form the second plane 1422.

The second plane 1422 may be defined as a plane generated by uniting lowermost portions of beams generated by the respective micro-LED chips 920 of the second group of micro-LED chips 920*g*2.

In some implementations, the vertical cross-section of the lens 1310 may contact the second plane 1422 having an angle of 55 to 65 degrees in the downward direction with the second optical axis 1432 extending from the second group of micro-LED chips 920*g*2 so as to be perpendicular to the array 200.

The lens 1310 is inscribed in the divergence angle 1410 and, thus, beams are uniformly output in both the overall width direction and the overall length direction. The lens 1319 converges beams, emitted upwards and downwards, in the direction perpendicular to the array 200 and, thus, beams are uniformly output in both the overall width direction and the overall length direction.

FIG. 15 is a cross-sectional view of a vehicle lamp in accordance with another implementation.

FIG. 15 schematically illustrates only the array 200 and the lens 1310 in the cross-sectional view of the vehicle lamp 100 of FIG. 13A, taken along the first plane 1391.

With reference to FIG. 15, a diameter 1510 in the vertical direction of the vertical cross-section of the lens 1310 may be determined based on the width of the array 200 in the vertical direction.

If the vertical cross-section of the lens 1310 has a circular shape, the diameter 1510 in the vertical direction of the vertical cross-section of the lens 1310 may be described as a diameter of the circular vertical cross-section of the lens 130.

If the vertical cross-section of the lens 1310 has an oval shape, the diameter 1510 in the vertical direction of the vertical cross-section of the lens 1310 may be described as a major axis or a minor axis of the oval vertical cross-section of the lens 130.

For example, the diameter 1510 in the vertical direction of the vertical cross-section of the lens 1310 may be 2 times to 10 times the width of the array 200. Particularly, the diameter 1510 in the vertical direction of the vertical cross-section of the lens 1310 may be 2 times to 4 times the length of the array 200 in the vertical direction.

Since the length of the vertical cross-section of the lens 1310 is determined based on the length of the array 200 in the vertical direction, beams output from the array 200 are not excessively spread upwards and downwards. Therefore, beams are converged in the direction perpendicular to the array 200 and, thus, beams are uniformly output in both the overall width direction and the overall length direction.

Figure 16:
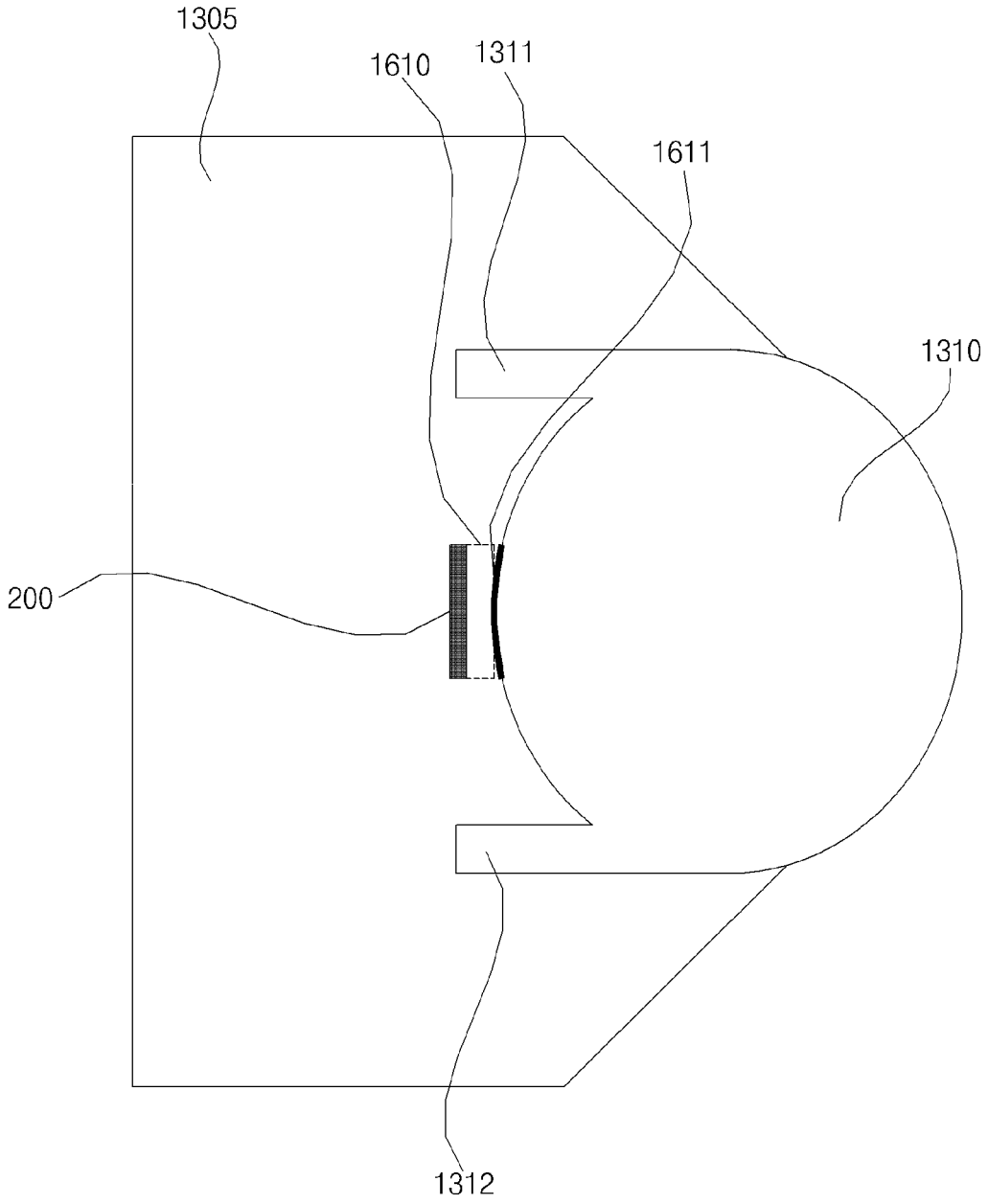
FIG. 16 is a cross-sectional view of a lamp for vehicles in accordance with another implementation.

FIG. 16 is a cross-sectional view of a vehicle lamp in accordance with another implementation.

FIG. 16 is a cross-sectional view of the vehicle lamp 100, taken along the first plane 1391.

With reference to FIG. 16, the vehicle lamp 100 may further include an air layer 1610.

The air layer 1610 may be formed between the array 200 and the lens 1310.

The air layer 1610 may prevent scattering of beams.

The air layer 1610 may have a thickness of 0.1 mm to 5 mm.

Here, the thickness may be described as a distance between the array 200 and the lens 1310.

At least one surface 1611 of the air layer 1610 may be formed convex toward the array 200, so that one side of the air layer curves away from the array 200, as shown in the example of FIG. 16.

For example, due to the circular or oval cross-section of the lens 1310, at least one surface 1611 of the air layer 1610 may be convex toward the array 200.

In some implementations, the main body 1305 may have a first groove and a second groove.

The lens 1310 may include a first protrusion 1311 combined with the first groove and a second protrusion 1312 combined with the second groove.

Figure 17:
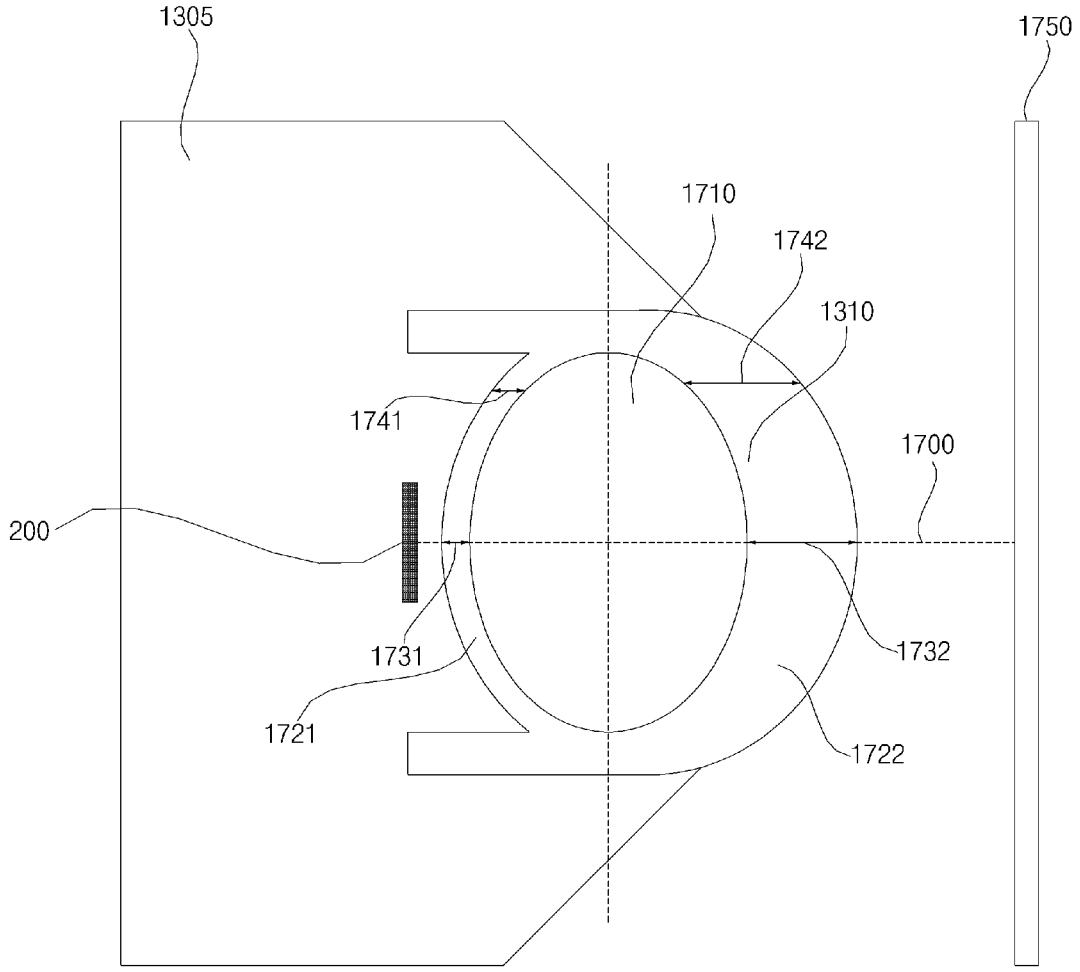
FIG. 17 is a cross-sectional view of a lamp for vehicles in accordance with yet another implementation.

FIG. 17 is a cross-sectional view of a vehicle lamp in accordance with yet another implementation.

With reference to FIG. 17, in some implementations the lens 1310 may have a hollow interior 1710 formed therein.

In some scenarios, the hollow interior 1710 formed in the lens 1310 may improve straightness of light in the direction perpendicular to the array 200.

Due to the hollow interior 1710 formed in the lens 1310, the lens 1310 may be divided into different portions arranged around the hollow interior 1710. For example, as shown in FIG. 17, the lens 1310 may be divided into a first member 1721 at one side of the hollow interior 1710, and a second member 1722 at an opposite side of the hollow interior 1710.

As such, the lens 1310 may include both the first member 1721 and the second member 1722, which may function as parts of the lens 1310.

As shown in FIG. 17, the first member 1721 of the lens 1310 may be located between the array 200 and the hollow 1710.

The second member 1722 of the lens 1310 may be located between the hollow 1710 and the outside of the vehicle.

The vehicle lamp 100 may further include a cover lens 1750. The cover lens 1750 may be formed of a transparent material. The cover lens 1750 may form an external appearance of the vehicle lamp 100 and protect the components of the vehicle lamp 100.

The second member 1722 may be located between the hollow 1710 and the cover lens 1750.

A thickness of the second member 1722 may be greater than a thickness of the first member 1721.

The thickness of the first member 1721 may be gradually decreased in the upward direction or the downward direction from an optical axis 1700 of the lens 1310.

For example, a thickness 1731 of a first point of the first member 1721 is bigger than a thickness 1741 of a second point of the first member 1721.

The first point of the first member 1721 may be defined as a point of the first member 1721 intersecting the optical axis 1700 of the lens 1310.

The second point of the first member 1721 may be defined as a point of the first member 1721 not intersecting the optical axis 1700 of the lens 1310.

The thickness of the second member 1722 may be gradually decreased in the upward direction or the downward direction from the optical axis 1700 of the lens 1310.

For example, a thickness 1732 of a first point of the second member 1722 is bigger than a thickness 1742 of a second point of the second member 1722.

The first point of the second member 1722 may be defined as a point of the second member 1722 intersecting the optical axis 1700 of the lens 1310.

The second point of the second member 1722 may be defined as a point of the second member 1722 not intersecting the optical axis 1700 of the lens 1310.

Figure 18:
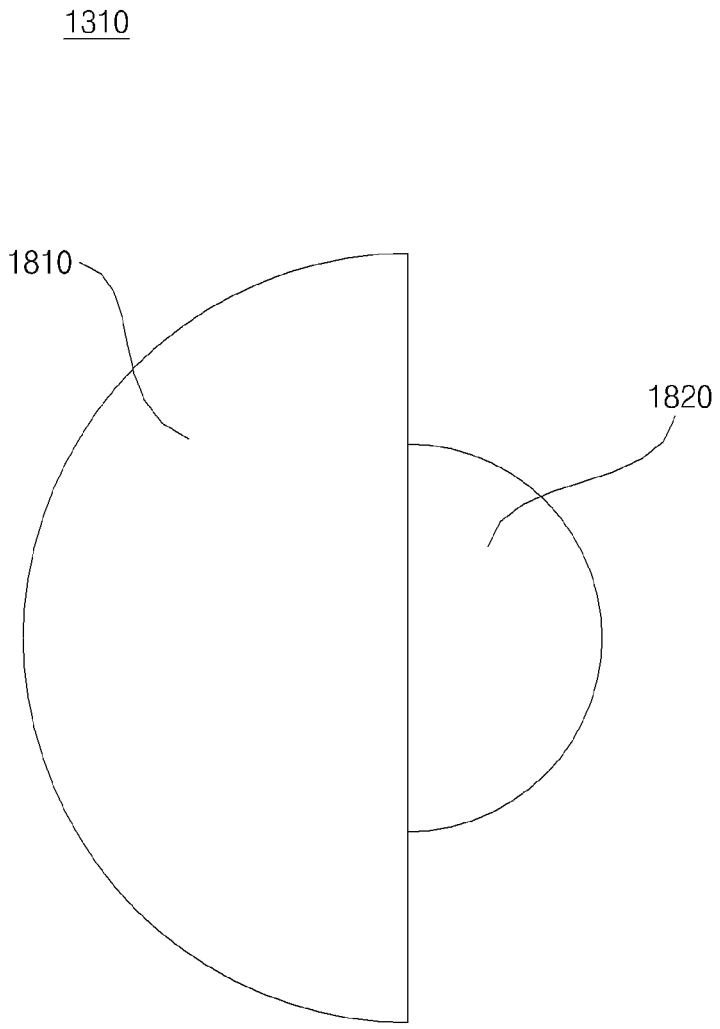
FIG. 18 is a cross-sectional view of a lens in accordance with one implementation.

FIG. 18 is a cross-sectional view of a lens in accordance with one implementation.

With reference to FIG. 18, the vertical cross-section of the lens 1310 may include a first shape 1810 and a second shape 1820.

The first shape 1810 may be a shape formed by a part of a first circle having a first radius.

The second shape 1820 may be a shape formed by a part of a second circle having a second radius.

The first shape 1810 may be located closer to the array 200 than the second shape 1820.

The first radius may be greater than the second radius.

Using a lens 1310 having a structure with such a first shape and a second shape shown in FIG. 18, a lamp 100 having a thinner structure may be manufactured. As such, in some scenarios, light concentration may be increased and, thus, drivers of other vehicles may more easily recognize the lamp 100.

In some implementations, a maximum thickness of the second shape 1820 may be greater than a maximum thickness of the first shape 1810. As such, in some implementations, even though the second shape 1820 corresponds to a second circle having a smaller radius than a first circle corresponding to the first shape 1810, the larger portion of the second circle may be used to define the second shape 1820, as compared to the portion of the first circle that is used to define the first shape 1810. As such, the maximum thickness of the second shape 1820 may be greater than the maximum thickness of the first shape 1810.

Figure 19A:
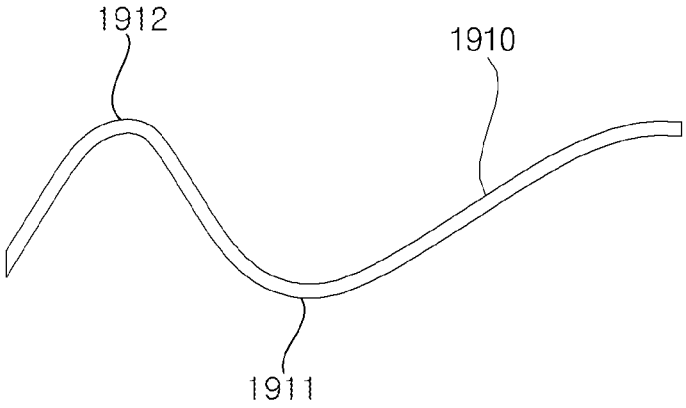
FIGS. 19A to 19C are views illustrating various shapes of a lamp for vehicles in accordance with one implementation.
Figure 19B:
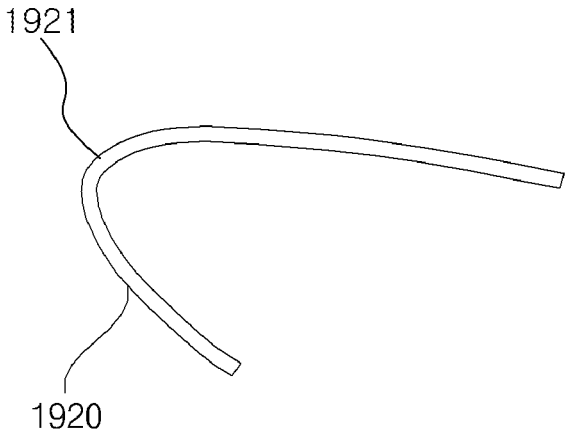
Figure 19C:
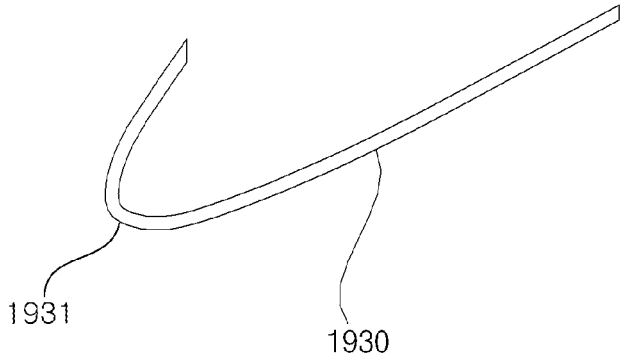

FIGS. 19A to 19C are views illustrating various shapes of a vehicle lamp in accordance with one implementation.

With reference to FIGS. 19A to 19C, a lens 1910, 1920 or 1930 may have various shapes corresponding to shapes of an array 200. For example, the lens 1910, 1920 of 1930 may have a similar shape to the shape of the array 200.

In some implementations, the vehicle lamp 100 may have a bent shape.

For example, the array 200 may include one or more bent parts formed in the length direction of the lamp 100.

The lens 1910, 1920 or 1930 may include one or more bent parts 1911, 1912, 1921 and 1931 formed in the length direction of the vehicle lamp 100.

The bent parts 1911, 1912, 1921 and 1931 of the lens 1910, 1920 or 1930 may be formed at a point(s) of the lens 1910, 1920 or 1930 corresponding to bent part(s) of the array 200. Here, the point of the lens 1910, 1920 or 1930 corresponding to the bent part of the array 200 may be defined as a point of the lens 1910, 1920 or 1930 contacting a virtual extension line extending from the bent part of the array 200 in the driving direction of the vehicle.

For example, the array 200 may include one or more bent parts. In this case, the lens 1910, 1920 or 1930 may include one or more bent parts 1911, 1912, 1921 and 1931 at a point(s) thereof corresponding to the one or more bent parts of the array 200. Here, the point of the lens 1910, 1920 or 1930 corresponding to the bent part of the array 200 may be defined as a point of the lens 1910, 1920 or 1930 contacting a virtual extension line extending from the bent part of the array 200 in the driving direction of the vehicle.

As such, the lens may be configured to have a shape that conforms to the shape of the array 200, and that efficiently directs light from the array 200 to an outside of the vehicle.

The above-described disclosure may be implemented as computer readable code in a computer readable recording medium in which a program is recorded. Computer readable recording media include all kinds of recording devices in which data readable by computer systems is stored. The computer readable recording media include a Hard Disk Drive (HDD), a Solid State Drive (SSD), a Silicon Disk Drive (SDD), a ROM, a RAM, a CD-ROM, a magnetic tape, a floppy disk, an optical data storage system, etc. Further, the computer readable recording media may be realized as a carrier wave (for example, transmission over the Internet). Here, a computer may include a processor or a controller.

As apparent from the above description, a vehicle lamp in accordance with one implementation has at least one of effects described below.

First, the vehicle lamp includes a plurality of micro-LEDs, thus securing required intensity of light.

Second, the vehicle lamp outputs beams having high uniformity due to a lens having a circular or oval vertical-cross section, which is inscribed in a divergence angle of output light in the vertical direction.

Third, the vehicle lamp allows drivers of other vehicles to recognize output light thereof, thus minimizing glare.

Although some implementations have been disclosed for illustrative purposes, those skilled in the art will appreciate that various modifications, additions and substitutions are possible, without departing from the scope and spirit of the disclosure as disclosed in the accompanying claims.

What is claimed is:

1. A lamp for a vehicle, the lamp comprising:

a light generation unit comprising an array provided with a plurality of micro-light emitting diode (micro-LED) chips arranged therein; and a lens configured to redirect light beams generated by the light generation unit, wherein the light generation unit is configured to output a plurality of beams having a divergence angle defined in a vertical direction, wherein the lens is arranged to have a largest vertical cross-section thereof inscribed in the divergence angle of the beams that are output from the light generation unit, wherein the plurality of micro-LED chips comprise:

a first group of micro-LED chips arranged at an uppermost portion of the array and configured to output first beams to an uppermost portion of a range of the beams, and a second group of micro-LED chips arranged at a lowermost portion of the array and configured to output second beams to a lowermost portion of the range of the beams, and wherein the divergence angle is defined between an uppermost part of the first beams output from the first group of micro-LED chips and a lowermost part of the second beams output from the second group of micro-LED chips.

2. The lamp for a vehicle according to claim 1, wherein the largest vertical cross-section of the lens contacts a first plane that extends from the first group of micro-LED chips and that forms an angle of 55 to 65 degrees in an upward direction relative to a first optical axis of the first group of micro-LED chips.

3. The lamp for a vehicle according to claim 1, wherein the largest vertical cross-section of the lens contacts a second plane that extends from the second group of micro-LED chips and that forms an angle of 55 to 65 degrees in a downward direction relative to a second optical axis of the second group of micro-LED chips.

4. The lamp for a vehicle according to claim 1, wherein the lens is configured to have a diameter along the largest vertical cross-section that is based on a width of the array formed in the vertical direction.

5. The lamp for a vehicle according to claim 4, wherein the lens is configured to have a diameter along the largest vertical cross-section that is 2 times to 10 times the width of the array formed in the vertical direction.

6. The lamp for a vehicle according to claim 1, further comprising an air layer that is defined between the array and the lens.

7. The lamp for a vehicle according to claim 6, wherein the air layer is defined to have a thickness of 0.1 mm to 5 mm.

8. The lamp for a vehicle according to claim 6, wherein a curvature of the lens defines at least one side of the air layer having a convex shape curving away from the array.

9. The lamp for a vehicle according to claim 1, wherein the lens is configured to have a hollow interior formed therein.

10. The lamp for a vehicle according to claim 9, wherein the lens comprises a first member and a second member that together define the hollow interior therebetween, the first member located between the array and the hollow interior, and the second member located between the hollow interior and an outside of a vehicle towards which light from the array is directed by the lens.

11. The lamp for a vehicle according to claim 10, wherein a second thickness of the second member of the lens is greater than a first thickness of the first member of the lens.

12. The lamp for a vehicle according to claim 1, wherein the lens is configured to have the largest vertical cross-section that comprises:

a first cross-sectional portion that is in a first shape of a part of a first circle having a first radius; and a second cross-sectional portion that is adjacent to the first cross-sectional portion and that is in a second shape of a part of a second circle having a second radius.

13. The lamp for a vehicle according to claim 12, wherein the first cross-sectional portion of the lens is located closer to the array than the second cross-sectional portion of the lens.

14. The lamp for a vehicle according to claim 13, wherein the first radius is greater than the second radius.

15. The lamp for a vehicle according to claim 12, wherein a maximum thickness of the second shape is greater than a maximum thickness of the first shape.

16. The lamp for a vehicle according to claim 1, wherein the lens comprises one or more bent parts formed along a length direction of the lens, and wherein the length direction is an inward or outward direction of the vertical cross-section of the lens.

17. The lamp for a vehicle according to claim 1, wherein the first beams define a first plane that is tangential to an upper portion of a circumference of the lens, and wherein the second beams define a second plane that is tangential to a lower portion of the circumference of the lens.

18. A lamp for a vehicle, the lamp comprising:

a light generation unit comprising an array provided with a plurality of micro-light emitting diode (micro-LED) chips arranged therein; and a lens that is configured to redirect light generated by the light generation unit, wherein the plurality of micro-LED chips comprise:

a first group of micro-LED chips arranged at an uppermost portion of the array, and a second group of micro-LED chips arranged at a lowermost portion of the array, wherein at least one of the first group of micro-LED chips is configured to output an uppermost portion of the light generated by the light generation unit, wherein at least one of the second group of micro-LED chips is configured to output a lowermost portion of the light generated by the light generation unit, wherein the lens is configured to redirect the light generated by the light generation unit by redirecting light that extends from the uppermost portion to the lowermost portion of the light generated by the light generation unit, wherein the uppermost portion of the light defines a first plane that extends outward from the at least one of the first group of micro-LED chips, wherein the lowermost portion of the light defines a second plane that extends outward from the at least one of the second group of micro-LED chips, and wherein the lens is configured to be inscribed within the first plane and the second plane.

19. The lamp for a vehicle according to claim 18, wherein the lens is configured to have a maximum cross-sectional width in a vertical direction that is 2 times to 10 times a width of the array in the vertical direction.

20. The lamp for a vehicle according to claim 18, wherein the first plane is tangential to an upper portion of a circumference of the lens, and wherein the second plane is tangential to a lower portion of the circumference of the lens.

* * * * *